US007458222B2

(12) United States Patent
Orr

(10) Patent No.: US 7,458,222 B2
(45) Date of Patent: Dec. 2, 2008

(54) HEAT EXCHANGER APPARATUS FOR A RECIRCULATION LOOP AND RELATED METHODS AND SYSTEMS

(75) Inventor: Troy J. Orr, Draper, UT (US)

(73) Assignee: Purity Solutions LLC, Draper, UT (US)

( * ) Notice: Subject to any disclaimer, the term of this patent is extended or adjusted under 35 U.S.C. 154(b) by 8 days.

(21) Appl. No.: 10/889,779

(22) Filed: Jul. 12, 2004

(65) Prior Publication Data

US 2006/0005954 A1 Jan. 12, 2006

(51) Int. Cl.
*F25B 9/02* (2006.01)

(52) U.S. Cl. ..... 62/5; 62/201; 62/434; 62/435; 165/101; 165/108; 165/163; 165/905; 165/157; 165/259

(58) Field of Classification Search ..... 165/108, 165/185, 163, 101, 905, 157, 259; 62/3.7, 62/3.3, 5, 201, 434, 435; 392/496
See application file for complete search history.

(56) References Cited

U.S. PATENT DOCUMENTS

| | | | | | |
|---|---|---|---|---|---|
| 2,056,920 | A | | 10/1936 | Demann | 257/340 |
| 2,383,193 | A | | 8/1945 | Herbert | 417/317 |
| 2,529,028 | A | | 11/1950 | Landon | 222/57 |
| 2,627,241 | A | * | 2/1953 | Przyborowski | 269/121 |
| 2,955,432 | A | * | 10/1960 | Hardebol et al. | 62/5 |
| 3,165,149 | A | | 1/1965 | Raible | 165/30 |
| 3,173,273 | A | * | 3/1965 | Fulton | 62/5 |
| 3,489,209 | A | | 1/1970 | Johnson | 165/133 |
| 3,526,274 | A | | 9/1970 | Gardner | 165/145 |
| 3,741,687 | A | | 6/1973 | Nystroem | 417/317 |
| 3,786,643 | A | | 1/1974 | Anderson et al. | |
| 3,848,660 | A | | 11/1974 | Reilly | 165/1 |
| 3,971,434 | A | * | 7/1976 | Martin et al. | 165/267 |
| 4,012,271 | A | * | 3/1977 | Brummett et al. | 156/423 |
| 4,047,844 | A | | 9/1977 | Robinson | 417/3 |
| 4,158,530 | A | | 6/1979 | Bernstein | 417/389 |
| 4,187,813 | A | * | 2/1980 | Stumpp | 123/510 |
| 4,240,261 | A | | 12/1980 | Inglis | 62/5 |
| 4,357,910 | A | * | 11/1982 | Blockley et al. | 122/248 |
| 4,412,553 | A | | 11/1983 | Kopp et al. | 137/118.06 |
| 4,479,760 | A | | 10/1984 | Bilstad et al. | 417/395 |
| 4,479,761 | A | | 10/1984 | Bilstad et al. | 417/395 |
| 4,583,920 | A | | 4/1986 | Lindner | 417/266 |
| 4,657,490 | A | | 4/1987 | Abbott | 417/478 |
| 4,671,347 | A | * | 6/1987 | MacCracken | 165/10 |

(Continued)

FOREIGN PATENT DOCUMENTS

JP 04126517 A * 4/1992

OTHER PUBLICATIONS

DuPont™ Fluoroproducts, *DuPont™ Teflon® PFA 450 HP*, Product Information, 3002119A, (Dec. 2001).

(Continued)

*Primary Examiner*—John K Ford
(74) *Attorney, Agent, or Firm*—Stoel Rives LLP

(57) ABSTRACT

A heat exchanger apparatus enables the temperature of a liquid located external to the apparatus in a recirculation loop to be controlled by heat transfer within the apparatus. A manifold fitting is also provided for distributing fluid from multiple conduits to a single conduit.

19 Claims, 17 Drawing Sheets

U.S. PATENT DOCUMENTS

| | | | | | |
|---|---|---|---|---|---|
| 4,735,261 | A | | 4/1988 | Huebner | 165/76 |
| 4,790,372 | A | | 12/1988 | Gemeinhardt et al. | 165/173 |
| 4,858,883 | A | | 8/1989 | Webster | 251/61.1 |
| 4,867,233 | A | | 9/1989 | Gemeinhardt | 165/173 |
| 5,010,736 | A | | 4/1991 | York et al. | 62/5 |
| 5,088,515 | A | | 2/1992 | Kamen | 137/15.17 |
| 5,205,126 | A | * | 4/1993 | Schnurr et al. | 62/5 |
| 5,259,352 | A | | 11/1993 | Gerhardy et al. | 123/509 |
| 5,342,182 | A | | 8/1994 | Montoya et al. | 417/477.1 |
| 5,344,292 | A | | 9/1994 | Rabenau et al. | 417/413.1 |
| 5,431,626 | A | | 7/1995 | Bryant et al. | 604/65 |
| 5,472,044 | A | | 12/1995 | Hall | 165/115 |
| 5,558,069 | A | * | 9/1996 | Stay | 123/541 |
| 5,573,385 | A | | 11/1996 | Chevallier | 417/393 |
| 5,577,552 | A | * | 11/1996 | Ebinuma et al. | 165/296 |
| 5,593,290 | A | | 1/1997 | Greisch et al. | 417/478 |
| 5,623,829 | A | | 4/1997 | Nutter et al. | 62/5 |
| 5,669,764 | A | | 9/1997 | Behringer et al. | 417/395 |
| 5,682,749 | A | | 11/1997 | Bristow et al. | 62/5 |
| 5,718,567 | A | | 2/1998 | Rapp et al. | 417/395 |
| 5,749,231 | A | | 5/1998 | Tunkel et al. | 62/5 |
| 5,832,991 | A | | 11/1998 | Cesaroni | 165/160 |
| 5,902,096 | A | | 5/1999 | Behringer et al. | 417/395 |
| 5,934,885 | A | | 8/1999 | Farrell et al. | 417/392 |
| 5,938,634 | A | | 8/1999 | Packard | 604/29 |
| 6,032,724 | A | | 3/2000 | Hatta | 165/80.2 |
| 6,079,959 | A | | 6/2000 | Kingsford et al. | 417/393 |
| 6,098,417 | A | | 8/2000 | Garrett | 62/371 |
| 6,102,106 | A | * | 8/2000 | Manning et al. | 165/163 |
| 6,106,246 | A | | 8/2000 | Steck et al. | 417/395 |
| 6,128,907 | A | | 10/2000 | Moi | 62/5 |
| 6,144,802 | A | | 11/2000 | Kim | 392/479 |
| 6,152,705 | A | | 11/2000 | Kennedy et al. | 417/395 |
| 6,168,394 | B1 | | 1/2001 | Forman et al. | 417/395 |
| 6,189,605 | B1 | * | 2/2001 | Lameris | 165/163 |
| 6,206,644 | B1 | | 3/2001 | Pereira et al. | 417/53 |
| 6,227,824 | B1 | | 5/2001 | Stehr | 417/540 |
| 6,229,753 | B1 | | 5/2001 | Kono et al. | 365/230.03 |
| 6,269,871 | B1 | | 8/2001 | Nishio et al. | 165/173 |
| 6,286,566 | B1 | | 9/2001 | Cline et al. | 141/83 |
| 6,289,912 | B1 | | 9/2001 | McPeak et al. | 137/15.18 |
| 6,367,669 | B1 | | 4/2002 | Au et al. | 222/504 |
| 6,401,463 | B1 | | 6/2002 | Dukhan et al. | 62/5 |
| 6,402,486 | B1 | | 6/2002 | Steck et al. | 417/395 |
| 6,477,855 | B1 | | 11/2002 | Findley et al. | 62/434 |
| 6,579,253 | B1 | | 6/2003 | Burbank et al. | 604/5.01 |
| 6,656,286 | B2 | | 12/2003 | Cho et al. | 118/728 |
| 6,668,136 | B2 | * | 12/2003 | Henry et al. | 392/496 |
| 6,723,062 | B1 | | 4/2004 | Westberg et al. | 604/4.01 |
| 6,759,007 | B1 | | 7/2004 | Westberg et al. | 422/44 |
| 6,804,965 | B2 | * | 10/2004 | Abras | 62/3.7 |

OTHER PUBLICATIONS

Pillar, Circulation System, Honeycomb Heat Exchanger, Pillar No. 8870, Cat. No. 519613 0103(K)1.

* cited by examiner 400c
410c
422c
420c
426c
424c
430c
440c
492c
490c
450c
460c
492c
400h
470h
492h
474h
472h
460h
490h
450h
440h
492h
490h
430h
420h
422h
410h
412h 432
432
430h 452
452
453
450h

HEAT EXCHANGER APPARATUS FOR A RECIRCULATION LOOP AND RELATED METHODS AND SYSTEMS

TECHNICAL FIELD

The present invention relates generally to the field of cooling and heating fluids. More particularly, the present invention relates to cooling and heating fluids in fluid recirculation loops, such as those used in the manufacture of semiconductor wafers, which require the avoidance or at least minimization of impurities being introduced into the fluid in the recirculation loop.

BRIEF DESCRIPTION OF THE DRAWINGS

Understanding that drawings depict only typical embodiments of the invention and are not therefore to be considered to be limiting of its scope, the invention will be described and explained with additional specificity and detail through the use of the accompanying drawings. The drawings are listed below.

INDEX OF ELEMENTS IDENTIFIED IN THE DRAWINGS

Figure 7:
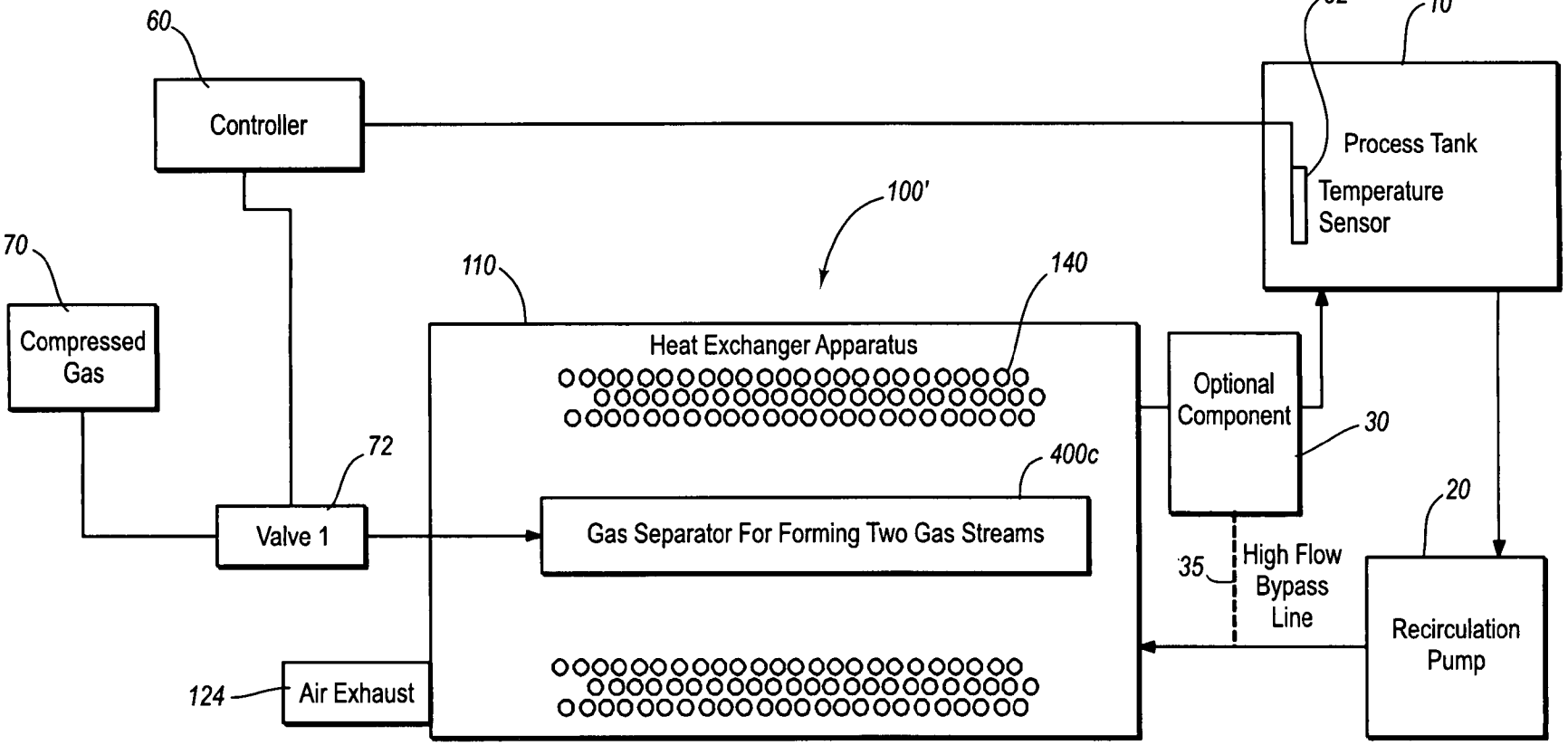
FIG. 7 is a schematic view of a method and system for heat transfer and temperature control of a process liquid wherein the heat exchanger apparatus has one gas separator adapted to separate pressurized gas into gas streams having different temperatures.

Elements shown in one or more of or discussed with reference to FIG. 1 and FIG. 7:

10 process tank
20 recirculation pump
30 optional component
35 bypass line
60 controller
62 temperature sensor
70 compressed gas source
72 first valve for gas delivery
74 second valve for gas delivery Elements shown in one or more of or discussed with reference to FIGS. 1, 2A-2C, 3A, 4A-4C, and 9A-9B:

100 heat exchanger apparatus
110 housing
112 shell
120 end cap
122 access portal
124 exhaust vent
130 end cap
140 heat transfer tubes
142*i* inlet ends of heat transfer tubes 140
142*o* outlet ends of heat transfer tubes 140
150 tube support combs
152 comb holes
160 baffle
162 baffle holes
164 baffle access Elements shown in one or more of or discussed with reference to FIGS. 2A-2C, 3A, 5, 6A-6E and 8:

200*i* inlet fitting
200*o* outlet fitting
210*i* inlet manifold fitting
210*o* outlet manifold fitting
212*i* first end of body 220*i*
212*o* first end of body 220*o*
214*i* second end of body 220*i*
214*o* second end of body 220*o*
216*i* passages
216*o* passages
218*i* face at the first end of body 220*i*
218*o* face at the first end of body 220*o*
220*i* body of inlet manifold fitting
220*o* body of outlet manifold fitting
222*i* seal interface of body 220*i*
222*o* seal interface of body 220*o*
224*i* track of body 220*i*
224*o* track of body 220*o*

226*i* groove of body 220*i*
226*o* groove of body 220*o*
240*i* manifold fitting receptacle
240*o* manifold fitting receptacle
242*i* threads of manifold fitting receptacle 240*i*
242*o* threads of manifold fitting receptacle 240*o*
244*i* sleeve portion of manifold fitting receptacle 240*i*
244*o* sleeve portion of manifold fitting receptacle 240*o*
250*i* fitting nut
250*o* fitting nut
252*i* threads of fitting nut 250*i*
252*o* threads (not shown) of fitting nut 250*o*
260*i* fluid communicator
260*o* fluid communicator
262*i* conduit of fluid communicator 260*i*
263*i* flared end of neck 264*i* of fluid communicator 260*i*
263*o* flared end of neck 264*o* of fluid communicator 260*o*
264*i* neck of fluid communicator 260*i*
264*o* neck of fluid communicator 260*o*
266*i* elbow of fluid communicator 260*i*
266*o* elbow of fluid communicator 260*o*
268*i* neck of fluid communicator 260*i*
268*o* neck of fluid communicator 260*o*
269*i* threads
269*o* threads
270*i* fitting nut
270*o* fitting nut
299 infrared heater Elements shown in one or more of or discussed with reference to FIGS. 1, 2C, 3A-3E, 4A-4C, 8 and 9A-9B:
300 gas separator housing
302 exhaust end of gas separator housing
304 delivery end of gas separator housing
306 grooves
308 baffle rim of gas separator housing 300
322 gas inlets
326 gas channels
328 gas channel extension
332 exhaust portal for gas separators 400*c* and 400*h*
334 delivery portals
342*c* access portal for gas separator 400*c*
342*h* access portal for gas separator 400*c*
360*c* cold gas stream chamber
360*h* hot gas stream chamber
370 delivery chamber Elements shown in one or more of or discussed with reference to FIGS. 3A-3E, 4A-4C, 8 and 9A-9B:
400*c* gas separator for delivery of stream of cold gas
400*h* gas separator for delivery of stream of hot gas
410*c* flow restrictor for gas separator 400*c*
410*h* flow restrictor for gas separator 400*h*
412*c* slot
412*h* slot
420*c* hot gas separator
420*h* hot gas separator
422*c* vent holes
422*h* vent holes
424*c* bands
424*h* bands
426*c* vent holes
426*h* vent holes
430*c* stream decoupler
430*h* stream decoupler
440*c* expansion chamber
440*h* expansion chamber
450*c* vortex generator
450*h* vortex generator
452*c* slanted tunnels
452*h* slanted tunnels
453*c* interior surface or perimeter
453*h* interior surface or perimeter
460*c* cold gas discharge nozzle
460*h* cold gas discharge nozzle
470*h* cold gas separator of gas separator 400*h*
472*h* vent holes
490 annular grooves
492 O-rings

DETAILED DESCRIPTION OF PREFERRED EMBODIMENTS

The inventions described hereinafter relate to a recirculation loop heat exchanger apparatus and related methods and systems. The apparatus enables the temperature of a liquid source located external to the apparatus to be controlled by heat transfer within the apparatus. The inventions also relate to specific components as utilized with a recirculation loop heat exchanger apparatus or another apparatus.

A heat exchanger apparatus for a recirculation loop has many uses in cooling and/or heating a fluid. One example of such a use is in the manufacture of semiconductor wafers. Maintenance of the temperature of fluids used during the manufacture of semiconductor wafers is needed during many of the processing steps. Examples of such fluids used in the semiconductor manufacturing process include liquids used to etch, liquids used in photolithography processes, rinsing liquids, and cleaning fluids. Examples of etching liquids include hydrogen peroxide ($H_2O_2$) and acids such as hydrofluoric acid (HF) and hydrochloric acid (HCL). Examples of liquids used in photolithography processes include resist liquids and developer liquids. Slurry solutions and chemicals used in chemical-mechanical planarization (CMP) are also examples of processes that can be sensitive to small changes in temperature. Examples of rinsing liquids include deionized water and liquids used in the process known in semiconductor manufacturing industry as the RCA clean such as RCA rinsing liquids. Components used to contact such liquids are formed from materials which remain chemically inert to the liquid.

In addition to controlling the temperature of fluids, the heat exchanger apparatus has a small footprint which is ideal for use in the manufacture of semiconductor wafers. Due to the costs of facilities used in the manufacture of semiconductor wafers, it is beneficial to minimize the space required for all devices utilized in the manufacturing process.

Figure 1:
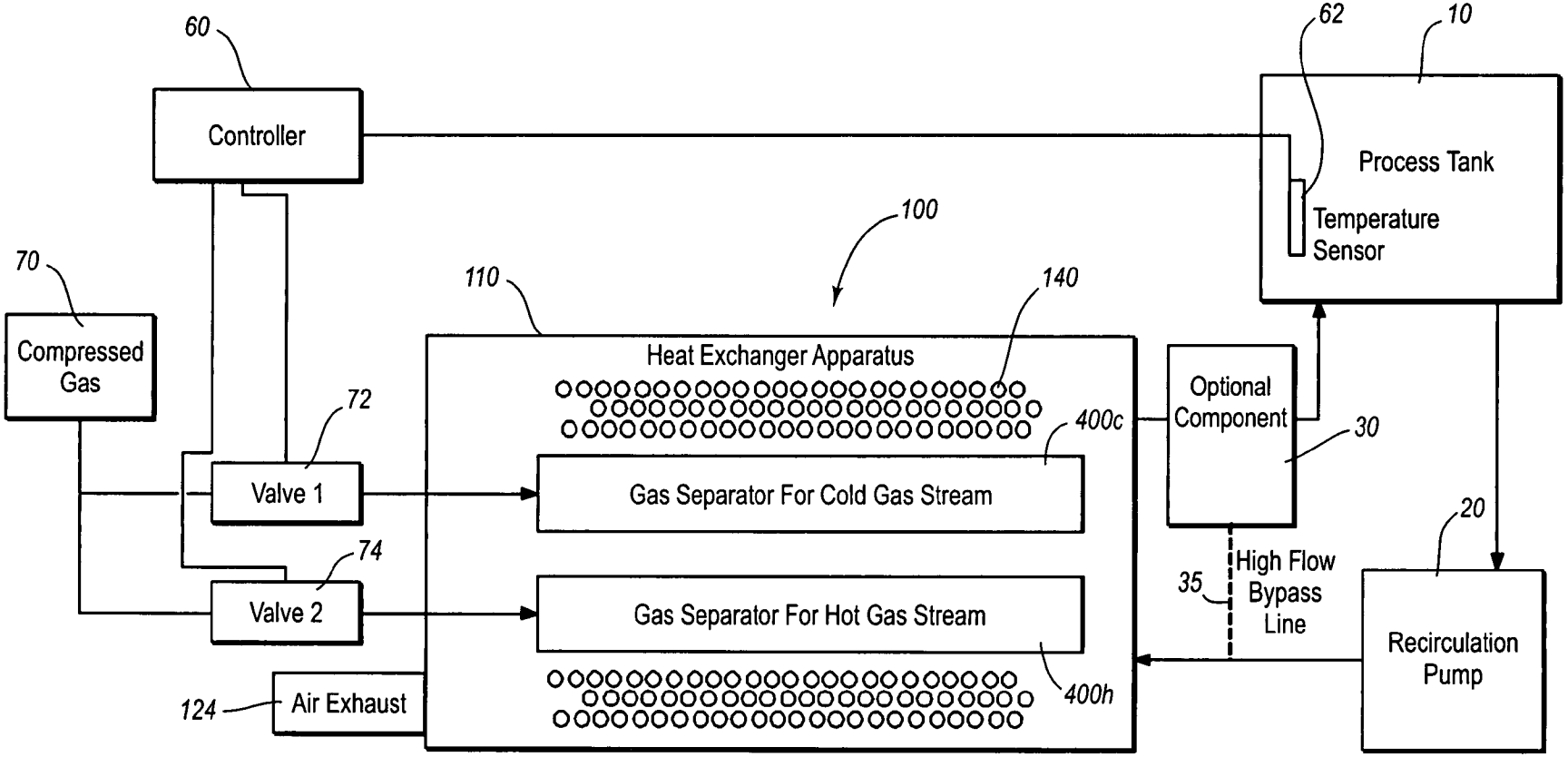
FIG. 1 is a schematic view of a method and system for heat transfer and temperature control of a process liquid wherein the heat exchanger apparatus has two gas separators adapted to separate pressurized gas into gas streams having different temperatures.

FIG. 1 is a schematic diagram of the system used to control the temperature of a liquid in a process tank 10. The embodiment of the heat exchanger apparatus shown at 100 has two gas separators identified at 400*c* and 400*h*. Gas separator 400*c* delivers a stream of cold gas into the housing 110 of heat exchanger apparatus 100 while gas separator 400*h* delivers a stream of hot gas into housing 110.

Fluid from process tank 10 flows to heat transfer tubes 140 or other heat transfer components via recirculation pump 20 which pressurizes the fluid. Fluid may optionally return from heat transfer tubes 140 after passing through an optional component 30 such as a flow meter, filter, valve, etc. Fluid may also be routed through a bypass line 35 for high flow to optional component 30 from the line or the fluid communicator which delivers the pressurized fluid to heat transfer tubes 140.

The temperature of process tank 10, the source of the fluid, is monitored and controlled via a controller 60 which is electronically coupled to a temperature sensor 62. Temperature sensor 62 is positioned to determine the temperature of the fluid in the process tank.

Compressed gas, such as nitrogen or air, is delivered to gas separator 400*c* and gas separator 400*h* in housing 110 of heat exchanger apparatus 100 from compressed gas source 70. First valve 72 controls gas delivery to gas separator 400*c*. Second valve 74 controls gas delivery to gas separator 400*h*. The compressed gas may be supplied to the gas separator at a flow rate of about 10 to about 30 standard cubic feet per minute (SCFM) and at a pressure of about 50 to 100 psig. For manufacturing semiconductor wafers, the compressed gas is typically supplied to the gas separator at a flow rate of about 10 SCFM and at a pressure of about 80 psig.

Apparatus 100 may be utilized to maintain a liquid in a process tank at room temperature (approximately 27° C.). For such a use, apparatus 100 may be designed to adjust the temperature of the process tank or ambient bath by ±5° C. to maintain it at approximately 27° C. Apparatus 100 may also be utilized to heat or cool the liquid beyond ambient temperature. The gas streams or fractions generated by the gas separators may have temperatures ranging from about −40° C. to about 110° C. The cold gas stream generated by the gas separator may have a temperature ranging from about 28° C. to about 50° C. below the temperature of the pressurized gas received by the gas separator. The amount of heat transferred by apparatus 100 varies depending on the design. For example, it may be designed to transfer about 75 to about 300 watts. It may be designed to transfer about 100 watts for typical uses in the manufacture of semiconductor wafers.

Figure 2A:
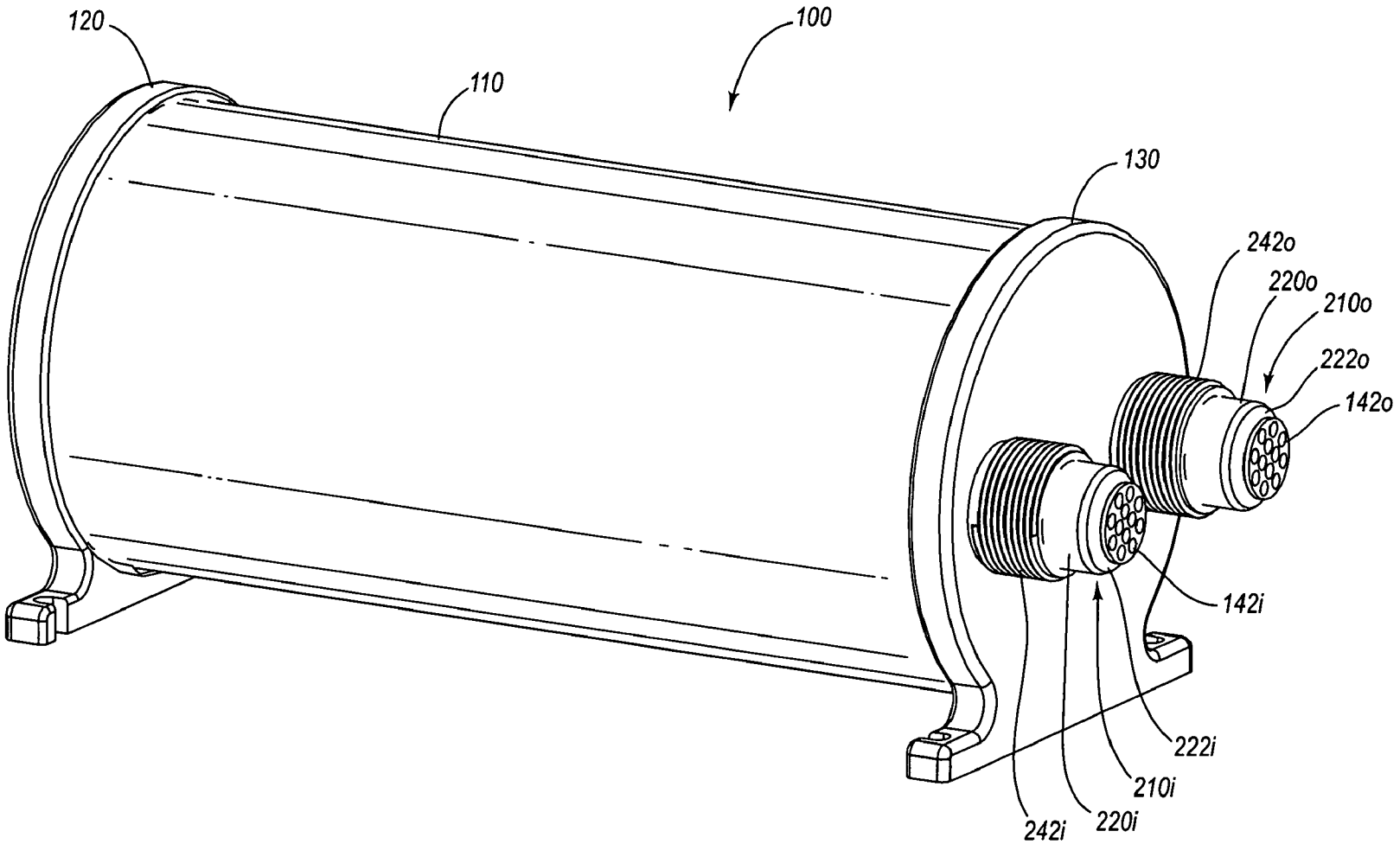
FIG. 2A is a perspective view of the housing of the heat exchanger apparatus with an inlet manifold fitting and an outlet manifold fitting extending through one of the end caps.

FIG. 2A shows housing 110. Housing 110 comprises shell 112 and end caps 120 and 130. Shell 112 is the open body of housing 110. End caps 120 and 130 are at opposite ends and butt up to shell 112.

Figure 5:
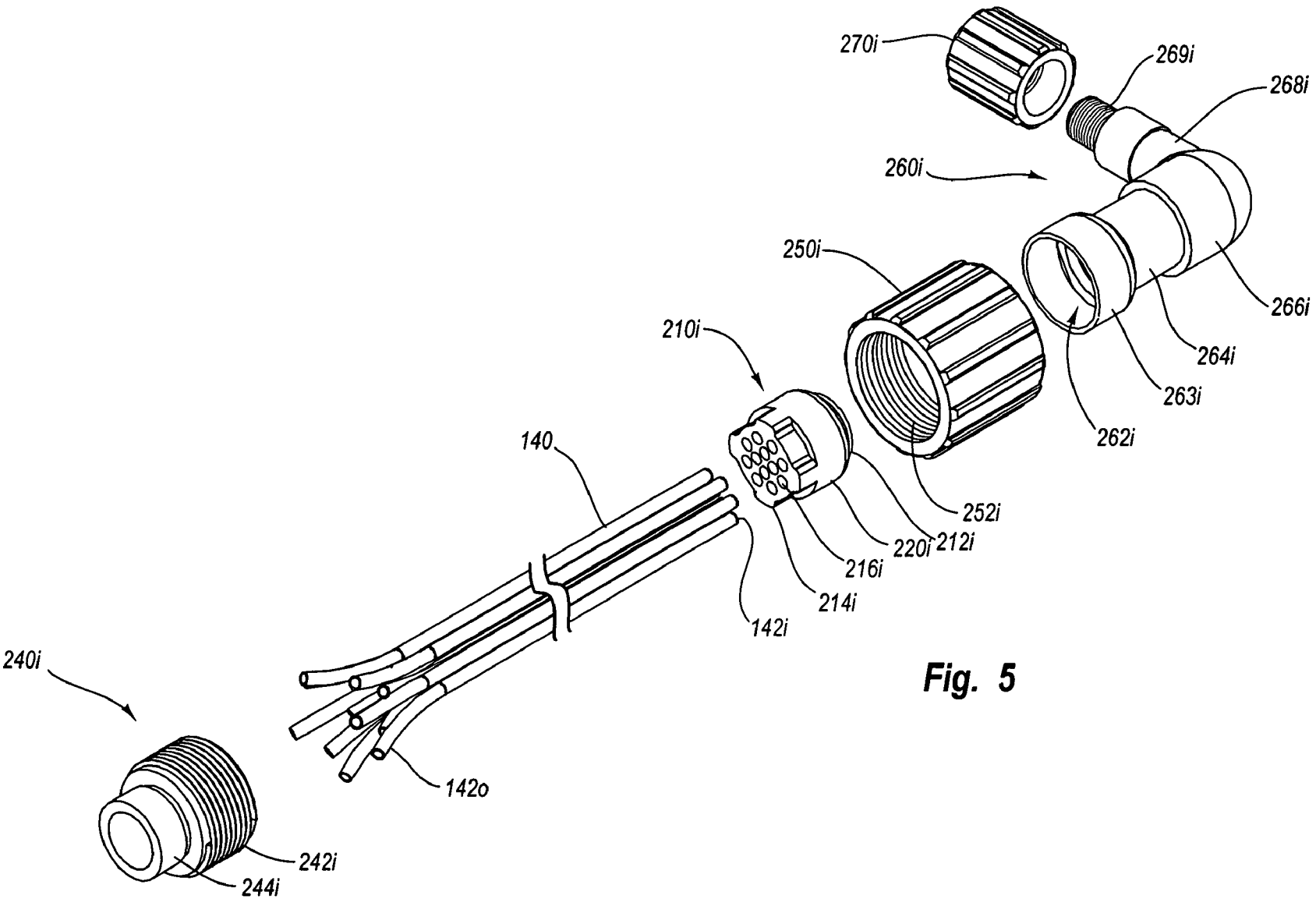
FIG. 5 is an exploded perspective view of the inlet fitting for the fluid which flows into the heat exchanger apparatus for heat transfer.

Inlet manifold fitting 210*i* and outlet manifold fitting 210*o* are shown extending through end cap 130. Inlet manifold fitting 210*i* and outlet manifold fitting 210*o* are respectively positioned within manifold fitting receptacle 240*i* and manifold fitting receptacle 240*o*. FIG. 5 provides a more detailed view of inlet manifold fitting 210*i* and outlet manifold fitting 210*o*. A method for manufacturing such fittings is described in reference to FIGS. 6A-6C.

Each manifold fitting has a body. Body 220*i* of inlet manifold fitting 210*i* and body 220*o* of outlet manifold fitting 210*o* are formed from a plastic material as described in more detail below. Body 220*i* of inlet manifold fitting 210*i* and body 220*o* of outlet manifold fitting 210*o* respectively hold the inlet ends 142*i* and outlet ends 142*o* of heat transfer tubes 140. This configuration permits each manifold fitting to be coupled with a single fluid communicator having only one conduit such as a tube or a bulkhead. FIG. 4B and FIG. 9B show tubes 140 extending through manifold fitting receptacle 240 and positioned in manifold fitting 210.

The clustering of the plurality of heat transfer tubes 140 at their ends enables a large volume of fluid to be delivered from and returned to process tank 10 or another source of fluid and to then be separated into much smaller volumes within housing 110 of apparatus 100. Separating the fluid into smaller volumes within the separate tubes of the plurality of heat transfer tubes 140 provides for more efficient heat exchange. Tubes 140 have a large surface area, a relatively thin wall thickness, and a relatively small inner diameter. These factors enhance the ability of the fluid in tubes 140 to be heated or cooled by gas contacting tubes 140.

Figure 2B:
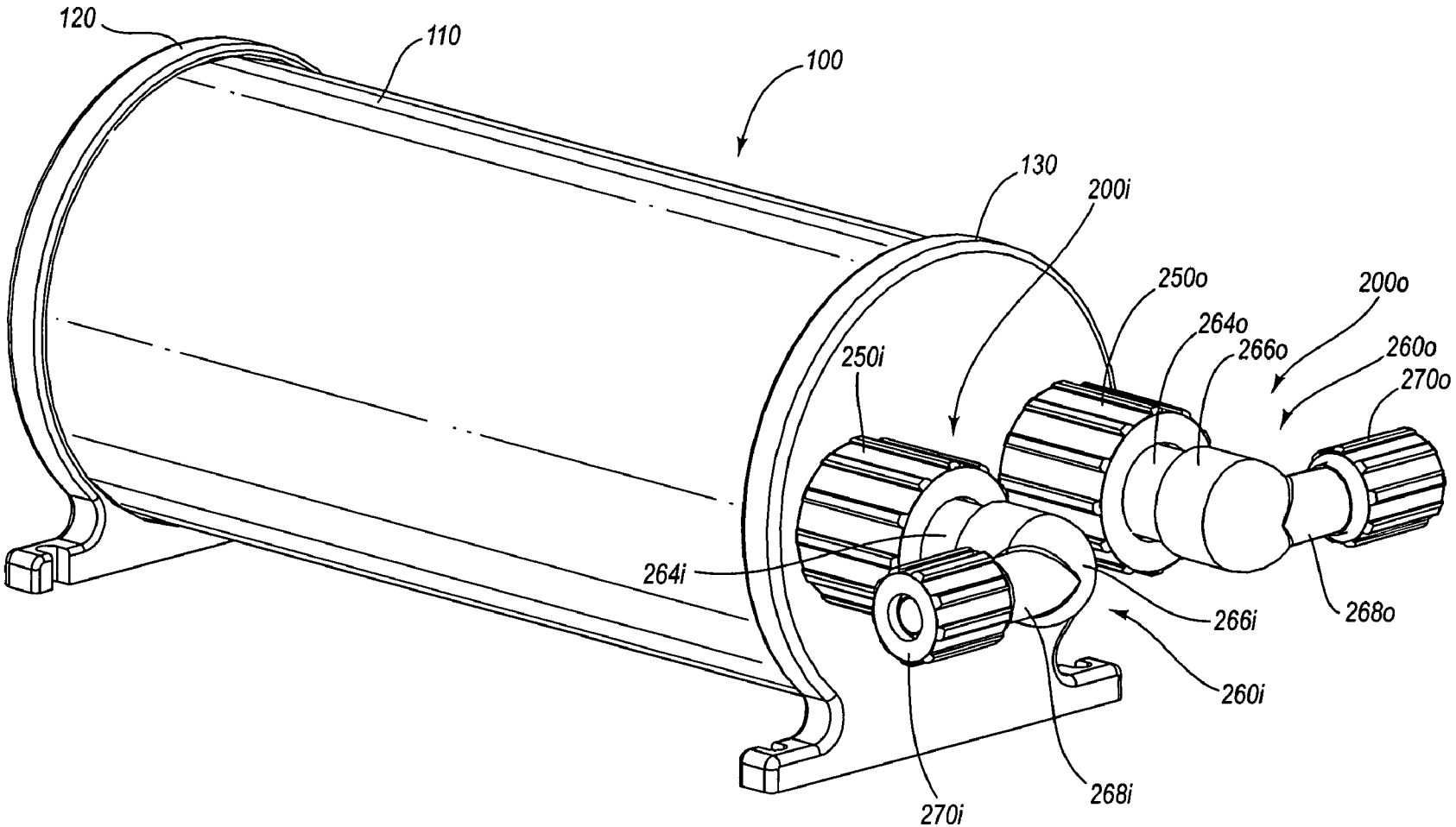
FIG. 2B is a perspective view of the same housing shown in FIG. 2A with complete inlet and outlet fittings.

FIG. 2B shows inlet fitting 200*i* and outlet fitting 200*o* fully assembled. The same components of inlet fitting 200*i* are shown in an exploded perspective view in FIG. 8. Note that, as shown, the components of outlet fitting 200*o* and inlet fitting 200*i* may be essentially identical. As shown in FIG. 2A, manifold fitting receptacle 240*i* and manifold fitting receptacle 240*o* both have threads which are respectively identified at 242*i* and 242*o*. Threads 242*i* and 242*o* are respectively engaged by the threads 252*i* (shown only in FIG. 5) of fitting nut 250*i* and threads 252*o* (not shown) of fitting nut 250*i*. Such threads are examples of locking components.

As mentioned above, the configuration of the manifold fittings permits the opposing ends of the plurality of heat transfer tubes 140 to be collectively coupled with a single fluid communicator having only one conduit such as a tube. Fluid communicator 260*i* and fluid communicator 260*o* are examples of such fluid communicators having only a single conduit. The fluid communicator may have more than one conduit. However, it is beneficial for the single conduit or multiple conduits to have a diameter or perimeter that is larger than the inner diameter or inner perimeter of tubes 240. Conduit 262*i* of fluid communicator 260*i* is shown in FIG. 5. FIG. 4B and FIG. 9B show the transition from manifold fitting 210 to fluid communicator 260.

The embodiments of fluid communicators depicted in FIG. 2B each comprise an elbow between necks. As shown in FIG. 5, neck 264*i* and neck 264*o* each have a flared end respectively identified at 263*i* and 263*o*. Flared ends 263*i* and 263*o* respectively seal against a seal interface 222*i* of body 220*i* and a seal interface 222*o* of body 220*o*. Respectively extending from the other ends of elbow 266*i* and 266*o* are necks 268*i* and 268*o*. Fitting nut 270*i* and fitting nut 270*o* are respectively positioned onto threads 269*i* and 269*o* of fluid communicator 260*i* and 260*o* to attach a tube or conduit (not shown).

Figure 2C:
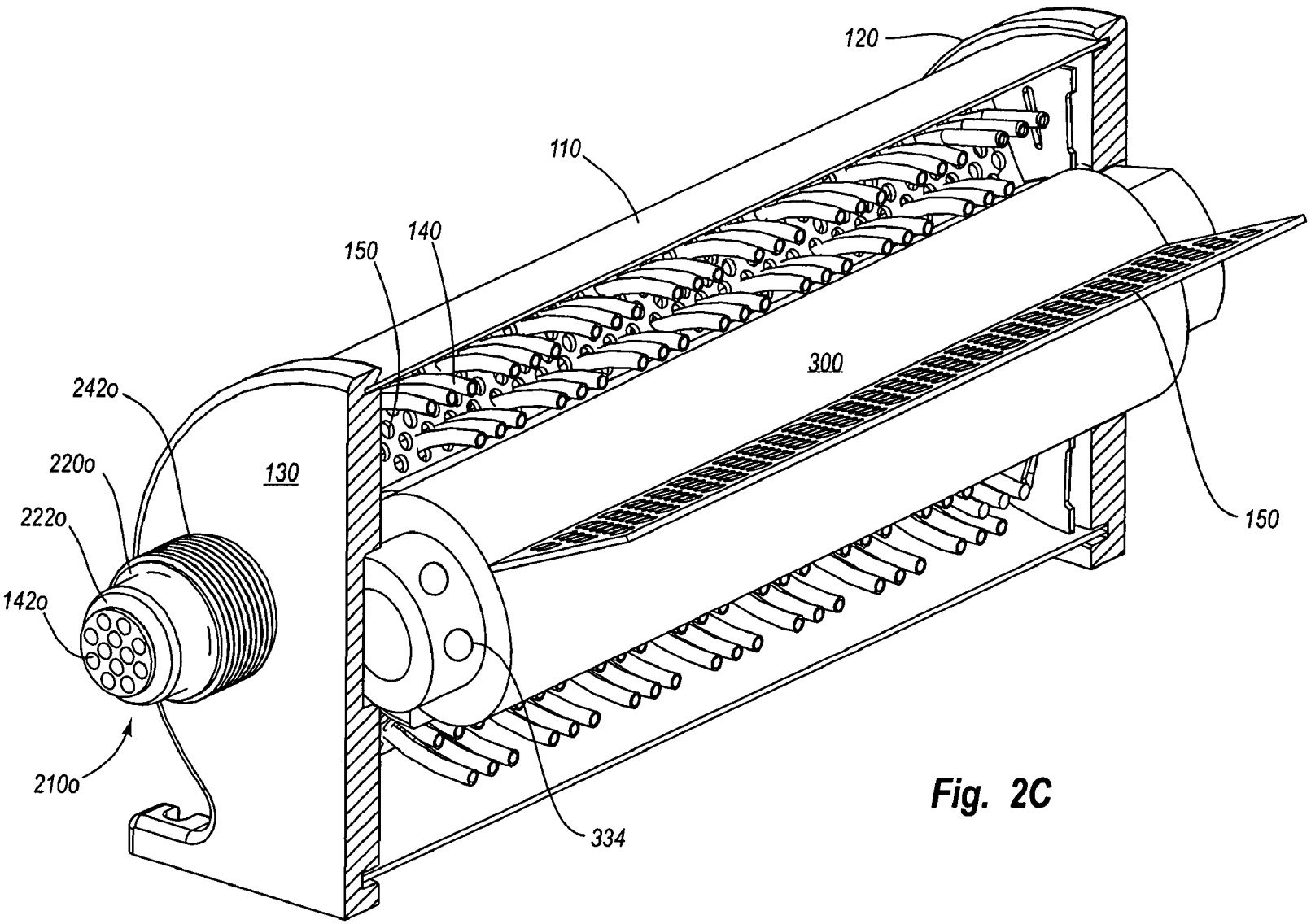
FIG. 2C is a perspective view of the heat exchanger apparatus with a partial cut-away view of the housing.
Figure 3A:
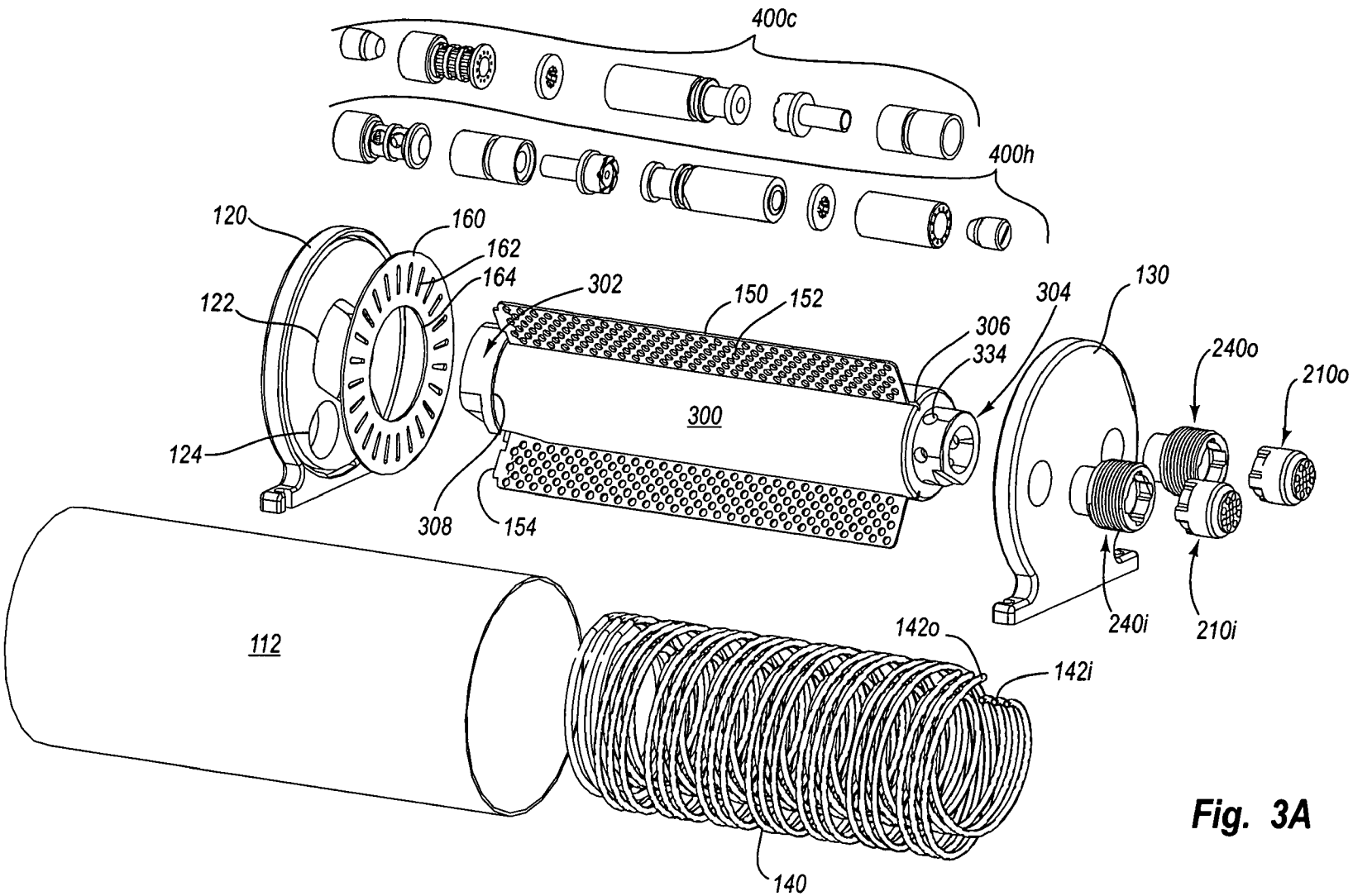
FIG. 3A is an exploded perspective view of the components of the heat exchanger apparatus.

FIG. 3A is an exploded perspective view of heat exchanger apparatus 100. Gas separator housing 300 has an exhaust end 302 opposite from delivery end 304. Along the length of gas separator housing 300 are grooves 306 which receive tube support combs 150. As shown in FIG. 2C, heat transfer tubes 140 are positioned within comb holes 152 of tube support combs 150. Support combs 150 have tabs 154 which are sized to permit them to be positioned in baffles holes 162 of baffle 160. Baffle 160 has an opening referred to as the baffle access 164 positioned around gas separator housing 300 against its baffle rim 308. The configuration of baffle 160 around gas separator housing 300 as it is held between support combs 150 and baffle rim 308 stabilizes support combs 150 and baffle 160.

Figure 3B:
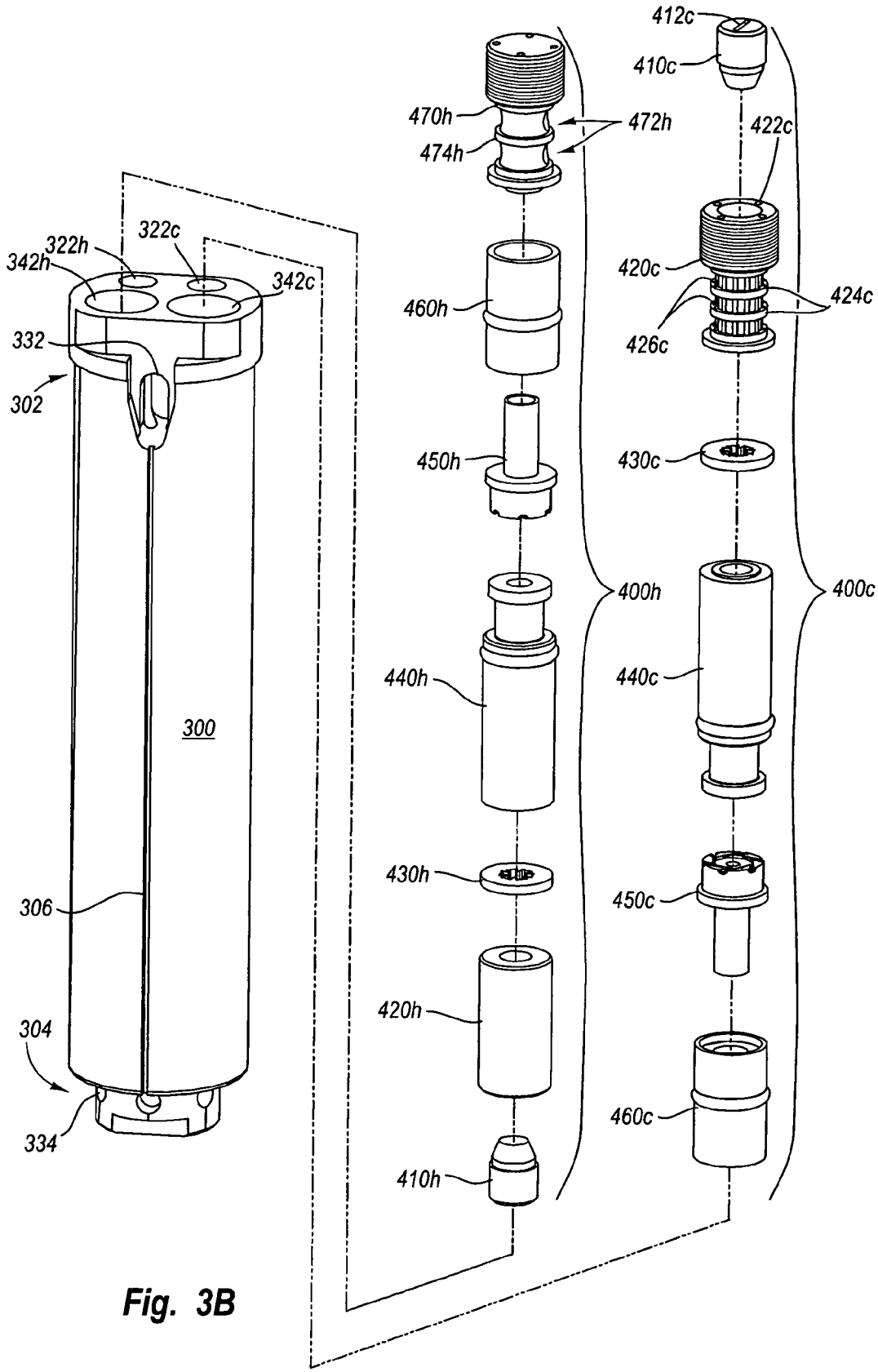
FIG. 3B an enlarged perspective view of the gas separator housing and an exploded perspective view of the components of the gas separator for delivery of a stream of cold gas and the gas separator for delivery of a stream of cold gas.
Figure 4A:
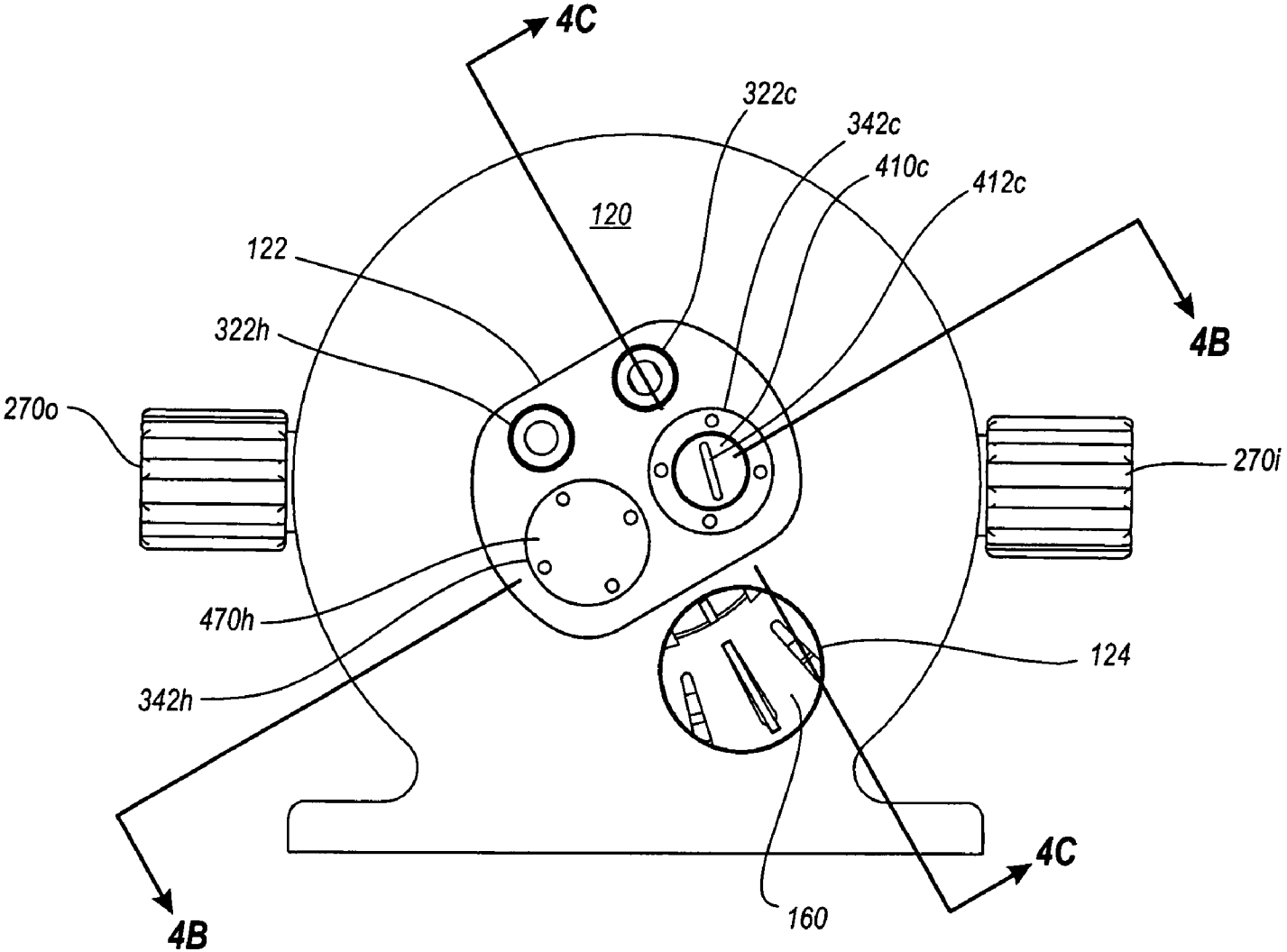
FIG. 4A is a perspective view of the side of the heat exchanger apparatus shown in FIG. 2B.
Figure 4B:
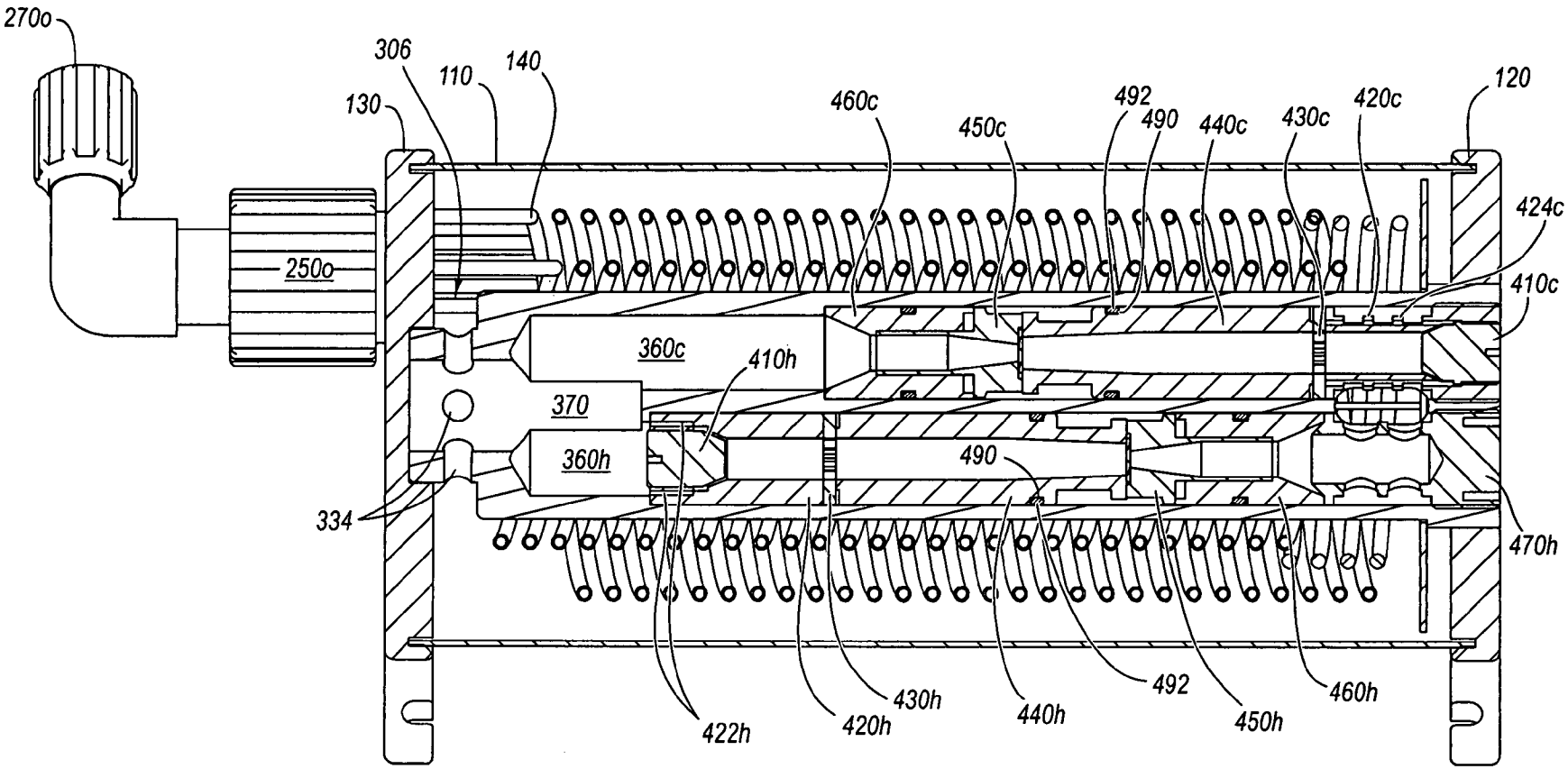
FIG. 4B is a cross-sectional view of the heat exchanger apparatus taken along cutting line 4B-4B in FIG. 4A.

Pressurized gas is introduced into gas separator housing 300 by a compressed gas line (not shown) and into gas inlets 322*c* and 322*h* shown in FIG. 3B and FIG. 4A. The pressurized gas then flows from gas inlets 322*c* and 322*h* respectively via gas channels, such as the gas channel identified in FIG. 4C at 326*c*, to gas separators 400*c* and 400*h*. The gas channel may include an optional gas channel extension such as the extension shown at 328*c*.

As discussed in more detail with respect to FIGS. 3B-3E, gas separator 400*c* and gas separator 400*h* each receive pressurized gas and separate the pressurized gas into two gas streams. Both gas separators separate the pressurized gas they receive into a high temperature stream and a low temperature stream relative to the temperature of the pressurized gas before separation. Gas separator 400*c* directs a relatively cooler gas stream into housing 110 and vents the relatively hotter gas stream it generated to exhaust vent 124. Gas separator 400*h* directs a relatively hotter gas stream into housing 110 and vents the relatively cooler gas stream it generated to exhaust vent 124. This configuration enables fluid in tubes 140 to be either cooled or heated as is needed. Note that the gas separators typically operate separately as simultaneous operation would counteract their ability to alter the temperature of the fluid in the tubes. The gas stream used for heat transfer is referred to herein as the heat transfer gas stream while the other gas stream is referred to as the bypass gas stream. Since the heat transfer gas stream delivered by gas separator 400*c* has a low temperature relative to the temperature of the pressurized gas before separation, the letter "c" is used to indicate that its heat exchange gas stream has a relatively cooler temperature. The letter "h" is used in association with gas separator 400*h* as its heat exchange gas stream has a relatively hotter temperature.

When gas separator 400*c* delivers a relatively cooler gas stream or gas separator 400*h* delivers a relatively hotter gas stream into the space defined by housing 110 for heat transfer with the fluid in tubes 140, the gas stream is delivered at delivery end 304 of gas separator housing via delivery portals 334. The other stream of gas vented by gas separator 400*c* (relatively hotter than the pressurized gas) or by gas separator 400*h* (relatively cooler than the pressurized gas), the bypass gas stream, is directed out of housing 100 in manner which limits its contact with the plurality of heat transfer tubes or other heat transfer components. Such a gas stream is directly vented via exhaust portal 332 out of gas separator housing 300. As best seen in FIG. 4A, the bypass gas streams exhausted by gas separator 400*c* and gas separator 400*h* via exhaust portal 332 out of gas separator housing 300 are vented out of heat exchanger apparatus 100 via exhaust vent 124 of end cap 120.

Exhaust vent 124, shown in FIGS. 3A and 4A, is also the exit for the streams of gas which have been used for the heat transfer with the fluid in tubes 140. The heat exchange gas streams are released into housing 110 out of gas separator housing 300 via delivery portals 334. After passing by tubes 140, these gas streams pass out of housing 110 via exhaust vent 124. As one of the gas separators operates, its heat exchange gas stream and its bypass gas stream recombine in housing 110 at the vent side of baffle 160 and exit exhaust vent 124. Note that exhaust vent 124 may be threaded for coupling with an external conduit to direct the discharged gas flow to a collector.

The heat exchange gas stream passes through baffle holes 162 of baffle 160 before exiting via exhaust vent 124, as best understood in reference to FIG. 3A and FIG. 4A. Baffle 160 provides uniform flow or distribution across tubes 140 so that the heat exchange gas stream is able to uniformly contact tubes 140. Baffle 160 provides a physical barrier to enhance circulation so that the heat exchange gas stream does not immediately exit via exhaust 124. Baffle 160 also allows the bypass gas stream to exit via the same vent as the heat exchange gas stream while isolating as much as possible the heat transfer tubes from the bypass stream. When the heat exchange gas stream has been released into the space defined by housing 110, its pressure has dropped significantly as compared with the pressure of the gas when delivered into the gas separator. However, as the heat exchange gas stream flows through baffle 160 and out of exhaust vent 124, it counters potential ingress of air or gas surrounding heat exchanger apparatus 100. The physical barrier of baffle 160 also further assists in minimizing the ingress of surrounding gas.

FIGS. 3A-3E provide detailed views of the components of the two gas separators in gas separator housing 300 which are identified as gas separator 400*c* and gas separator 400*h*. The general operation of the gas separators and each of their respective individual components will now be described in detail. In the discussion below, each of the components that are common to both gas separator 400*h* and gas separator 400*c* will be described with reference to a generic reference numeral while the same components are identified in the drawings by reference numerals which include the letter "c" or "h" to designate which gas separator the component is used with in gas separator housing 300. Whenever a component in one gas separator is different from the corresponding component in the other or is not present in the other, that component will be described with reference to a specific reference numeral which includes the letter "c" or "h" to designate which gas separator the component is used with in gas separator housing 300.

Gas separators 400*c* and 400*h* each include a flow restrictor 410, a hot gas separator 420, a stream decoupler 430, an expansion chamber 440, a vortex generator 450, and a cold gas discharge nozzle 460. Gas separator 400*h* also includes a cold gas separator 470*h*.

Figures 3C, 3D, 3E:
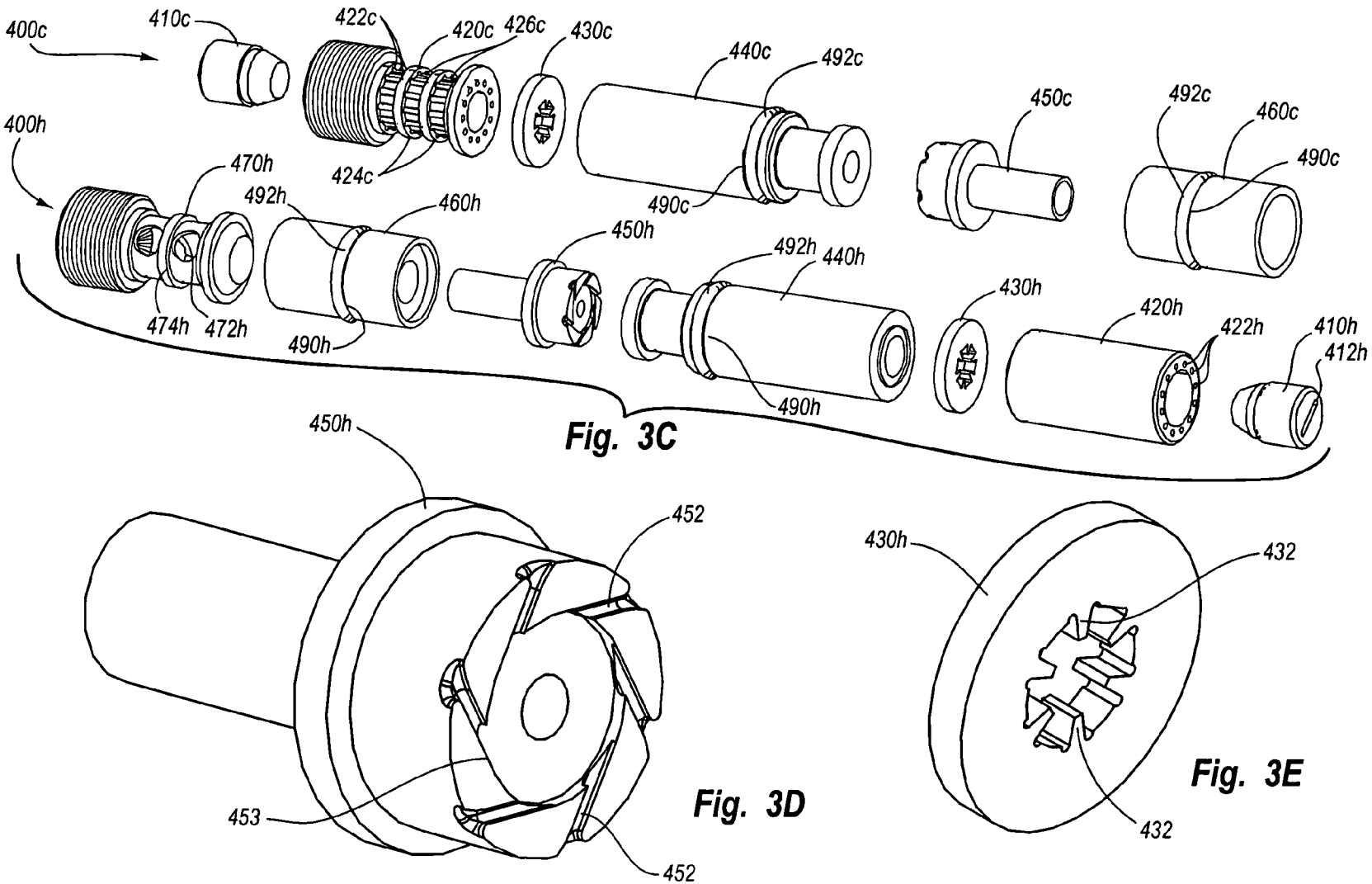
FIG. 3C an exploded perspective view of the components shown in FIG. 3B from another viewing angle.
FIG. 3D is an enlarged perspective view of a vortex generator.
FIG. 3E is an enlarged perspective view of a stream decoupler.

The compressed gas is introduced directly into vortex generator 450 via gas channel 326. Vortex generator 450 forces the pressurized gas to rotate and thereby create a vortex from the pressurized gas. As seen in FIG. 3D, vortex generator 450 has a plurality of slanted tunnels 452 that direct the gas along the interior surface or perimeter 453 of the internal bore of the device. Tunnels 452 direct gas into the bore of the gas separator at an angle that is at least approximately tangential to the interior surface 453 to initiate the rotation of the pressurized gas.

The vortex is forced down the expansion chamber 440 towards the stream decoupler 430. The vortex travels down expansion chamber 440 along the inside perimeter of the chamber. Although the expansion chamber shown in the accompanying drawings is tapered such that its interior diameter increases as it approaches the stream decoupler 430, other embodiments are possible. For instance, the expansion chamber could have a uniform interior diameter or, alternatively, its interior diameter could decrease as it approaches the stream decoupler. Although stream decoupler 430 need not be present in all embodiments of gas separators, it has been found that, under certain conditions, it may be useful to include a stream decoupler to straighten out the vortex somewhat prior to venting the hot gas stream through the hot gas separator 420. Stream decoupler 430 has an opening with a plurality of projections or vanes 432, as best seen in FIG. 3E, which facilitate straightening the outer regions of the vortex.

After passing through stream decoupler 430, the now hot gas at the perimeter of the interior bore of the gas separator is vented by hot gas separator 420. Although they serve essentially the same purpose, it can be seen from the accompanying figures that hot gas separator 420*h* differs structurally from hot gas separator 420*c*. It should be understood, however, that some embodiments of the invention may have two gas separators, each of which have components which are identical.

Hot gas separator 420*h* has a plurality of vent holes 422*h*. The hot gas stream is vented through the hot gas separator 420*h* and then out through vent holes 422*h*. As is discussed in greater detail below, the amount of hot gas that is allowed to vent through vent holes 422*h* may be controlled by controlling how far flow restrictor 410*h* is threaded into hot gas separator 420*h*.

Hot gas separator 420*c* instead directs the hot gas through vent holes 422*c* that lead back towards the center of the device and outside of the interior bore. Optionally, one or more bands 424 may be disposed around the perimeter of the region to which the hot gas is directed, as shown in the accompanying figures. These bands 424 may also have vent holes 426*c* that are coaxial with vent holes 422*c*. Bands 424 may be used to provide support for a gas permeable muffling cover (not shown). Such a cover may be comprised of any suitable material which allows gas to permeate there through and may be tightly fit over bands 424 in order to reduce the noise associated with venting the hot gas.

After the hot gas stream is vented from the gas separator, the remaining gas stream is reflected off of flow restrictor 410 and travels down the center of the gas separator in the opposite direction. Flow restrictor 410 may be adjustable so as to allow the temperature and volume of the cold and hot streams of gas to be varied. In the depicted embodiment, adjustment of flow restrictor 410 may be made by screwing and unscrewing the flow restrictor 410. For example, a screwdriver may be inserted via access portal 122 of housing 100 and access portal 342*c* of gas separator housing 300 into slot 412*c*. As the flow restrictor 410 is unscrewed, or threaded away from the hot gas separator 420, a greater portion of hot gas is released from the hot gas separator 420. This likewise affects the volume and temperature of cold gas released from the opposite side of the gas separator. Note that, as shown in FIG. 4A, access portal 342*c* for gas separator 400*c* is adjacent to access portal 342*h* for gas separator 400*c*

As it travels down the center of the gas separator, the gas transfers heat- to the gas spiraling in the other direction along the interior perimeter of the gas separator and is thereby cooled. In the depicted embodiment, the cold gas is vented through cold gas discharge nozzle 460. Cold gas discharge nozzle 460 may optionally be adapted to be fit with a vent tube to direct the cold gas to a desired location. In the depicted embodiment, cold gas discharge nozzle 460*c* sends the cold gas stream down a portion of gas separator housing 300, including the cold gas stream chamber 360*c* and delivery chamber 370, and out one or more delivery portals 334 in housing 300, which allows the gas stream to contact the heat transfer tubes 140. Note that delivery chamber 370 also receives hot gas from hot gas stream chamber 360*h* as the hot gas proceeds out of delivery portals 334.

A gas permeable muffler (not shown) may be located in the vent tube. For example, a muffler may comprise a plastic material, such as a woven polypropylene around hot gas separator 420*c* or an open cell foam in delivery chamber 370. Such a device may be comprised of any suitable material which allows gas to permeate there through and reduce the noise associated with venting the cold gas.

Gas separator 400*h* has an additional component-cold gas separator 470*h*—which is connected with cold gas discharge nozzle 460*h*. Cold gas separator 470*h* has vent holes 472*h*, which direct a cold gas stream out of the heat exchanger apparatus 100 via exhaust vent 124. Like hot gas separator 420*c*, cold gas separator 470*h* may have one or more bands 474*h*, and may also be fit with a gas permeable muffling cover (not shown) similar to that described above in connection with the hot gas separator 420*c*.

In embodiments of the invention including two gas separators, such as the embodiment shown in FIGS. 3A-3C having gas separators 400*c* and 400*h*, cold gas and hot gas stream can alternatively or simultaneously be introduced into the space defined by the apparatus housing 110 and adjacent to the heat transfer tubes 140. This allows for maintenance of a liquid bath at a relatively constant temperature, within any desired range of temperatures, which is located remotely with respect to apparatus 100. In other words, when the liquid bath is at or near a temperature which is undesirably high, gas separator 400*c* is utilized, which introduces cold gas into the space adjacent to heat transfer tubes 140. Likewise, when the liquid bath is at or near a temperature which is undesirably low, gas separator 400*h* is utilized, which introduces hot gas into the space adjacent to heat transfer tubes 140.

Of course, embodiments of the invention having only a single gas separator are also envisioned as described in reference to FIGS. 7-8 and FIGS. 9A-9B. Such embodiments may be used, for example, in environments in which it is desirable to keep a liquid bath above or below the environment temperature. For instance, if it is desired to keep a liquid bath at a temperature below the temperature of the environment, only a single gas separator is necessary to introduce cold gas into the heat transfer tubes.

Many of the fundamental aspects of the gas separators are well-known to those of skill in the art, as demonstrated by U.S. Pat. No. 3,173,273 issued to Fulton; U.S. Pat. No. 4,240,261 issued to Inglis; U.S. Pat. No. 5,558,069 issued to Stay; U.S. Pat. No. 5,682,749 issued to Bristow et al.; and U.S. Pat. No. 6,032,724 issued to Hatta. All of the foregoing references are hereby incorporated by reference in their entirety.

Gas separators 400 may be fit within gas separator housing 300, which may be configured to receive one or more gas separators. Gas separators 400 or, more particularly, one or more gas separator components, may also be configured with annular grooves 490. Each annular groove 490 may then be fit with an O-ring 492. Use of O-rings allows for creation of one or more seals to direct the gas to desired locations and/or prevent the passage of gas to undesired locations.

FIG. 5 depicts inlet fitting 200*i* in an exploded perspective view. In addition to the other components of inlet fitting 200*i*, inlet manifold fitting 210*i* is best seen in FIG. 5. Inlet manifold fitting 210*i* has a body 220*i* with a first end 212*i* opposite from a second end 214*i*. Passages 216*i* extend from first end 212*i* to second end 214*i*.

Figure 6C:
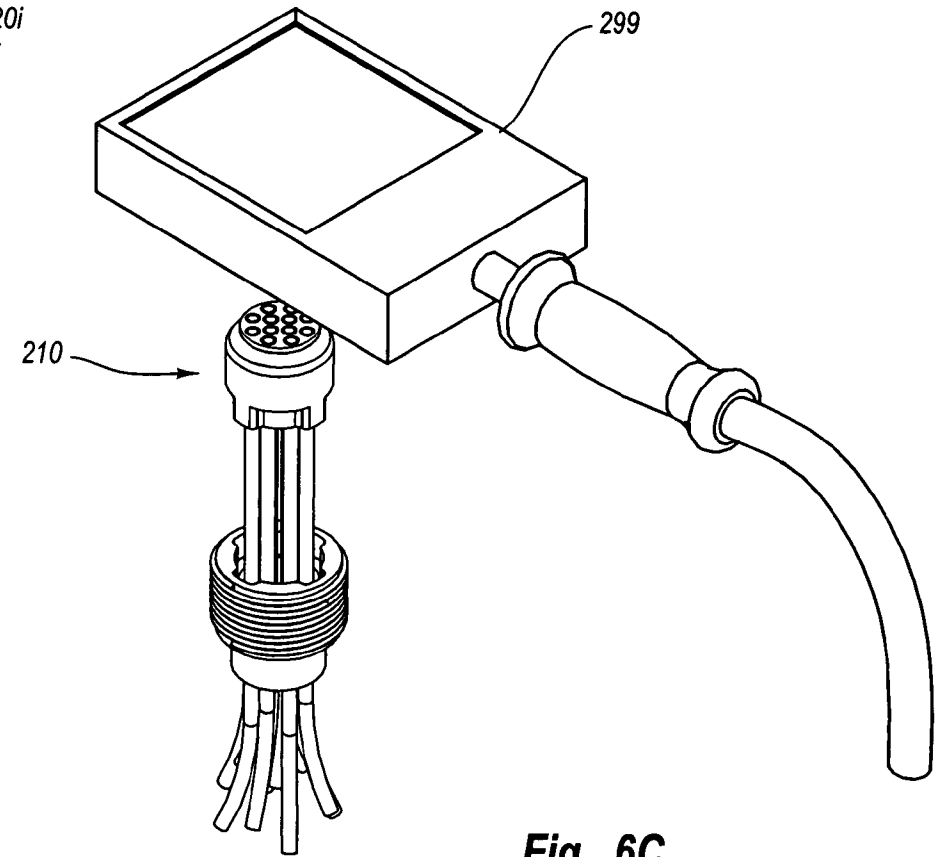
FIG. 6C depicts an infrared heater exposing the inlet ends of the tubes and the portion of the body of the manifold fitting under its face to fuse the tubes and the body at least under its face.
Figure 6A:
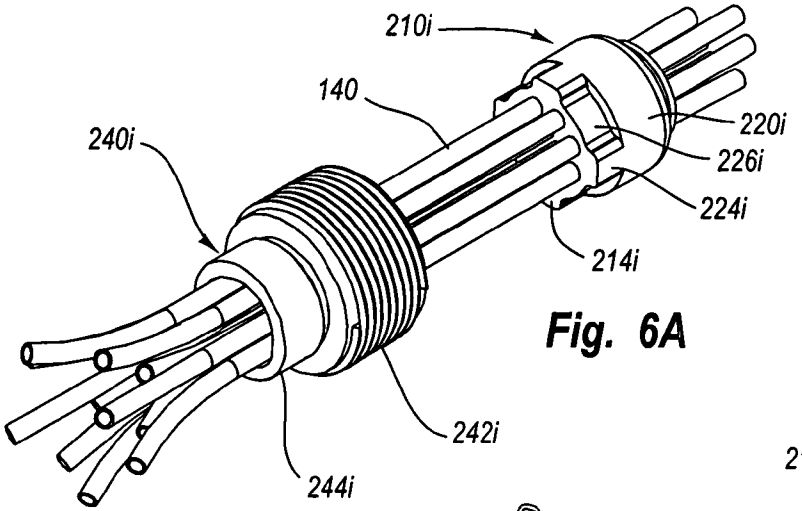
FIG. 6A depicts the heat exchange tubes after being positioned within the passages of the body of a manifold fitting such that they extend beyond the first end of the body.
Figure 6B:
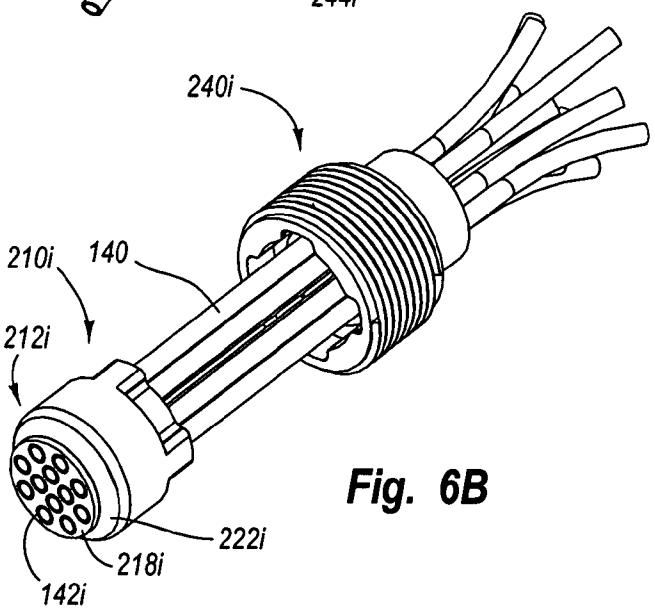
FIG. 6B depicts tubes 140 have been cut off to be as close as possible to being flush with the face of the body of the manifold fitting.

FIGS. 6A-6C depict the manufacture of inlet manifold fitting 210*i*. FIG. 6A depicts tubes 140 after being pulled through passages 216*i* and beyond first end 212*i* of inlet manifold fitting 210*i*. Note that the while the outer diameter of each tube 140 may be slightly smaller than the diameter of each passage 216*i*, they may also be approximately the same. Ends of tubes 140 are then cut off as shown in FIG. 6B to be as close as possible to being essentially flush with face 218*i* of body 220*i*. FIG. 6C depicts infrared heater 299 exposing at least a portion of body 220*i* and tubes 140 to fuse at least body 220*i* and tubes 140 at face 218*i*.

Figure 6E:
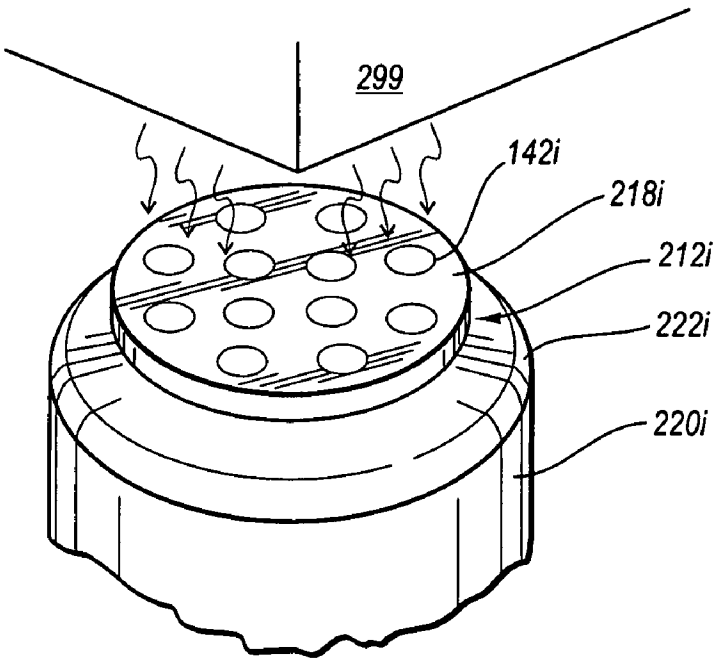
FIG. 6E depicts the inlet ends of heat transfer tubes after being fused to the body of the manifold fitting.
Figure 6D:
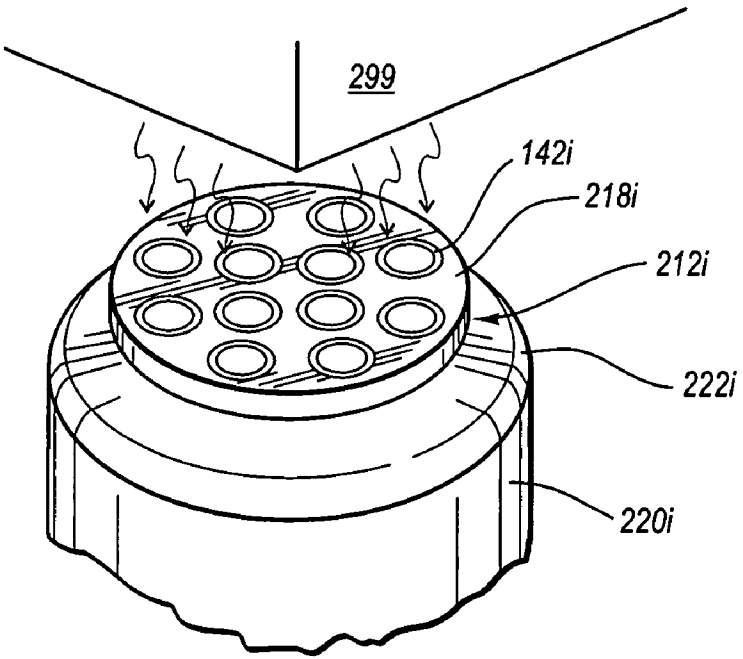
FIG. 6D depicts the inlet ends of heat transfer tubes before being fused to the body of the manifold fitting.

FIGS. 6D-6E depict the inlet ends 142*i* of heat transfer tubes 140 before and after being fused to body 220*i*. As shown in FIG. 6D, tubes 140 and body 220*i* are distinct from each other at the initiation of being heated. More particularly, the outer diameter of tubes 140 are not mechanically attached to body 220*i*. After being heated, as shown in FIG. 6E, the outer diameter of tubes 140 have fused with body 220*i* such that they are mechanically attached and the complete perimeter is sealed to body 220*i*.

The objective of heating tubes 140 and the portion of body 220*i* below face 218*i* is to form a fluid-tight seal between the outer diameter of tubes 140 and body 220*i* so when fluid is transferred from a fluid communicator all of the fluid flows into tubes 140 and not around tubes 140 into passages 216*i*. As mentioned above, in addition to a fluid-tight seal the heat may result in the elimination of the interface or an interface which is difficult to visibly identify on face 218*i*. Such results are achieved primarily through the use of plastics which are either identical or are sufficiently compatible to have similar melting temperatures. Other variables include the duration of the exposure to the heating source, the proximity of the heat source to face 218*i*, and the wall thickness of tubes 140.

The bodies of the manifold fittings and tubes 140 may be formed from any plastic material which remains inert to fluids such as hydrofluoric acid and other liquids used in manufacturing semiconductor wafers. Fluoropolymers are examples of suitable plastics. Specific examples of fluoropolymers which remain inert during exposure to various fluids include:

polytetrafluoroethylene (PTFE) sold as Teflon, fluorinated ethylene propylene (FEP), polyperfluoroalkoxyethylene (PFA) and polyvinyl difluoride (PVDF). Other plastics which may be utilized include polypropylene (PP), polyvinyl chloride (PVC), and polyvinyl difluoride (PVDF). The other components of heat exchanger apparatus 100 may also be formed from such plastics.

The plastic components are heated at or above their melting points to fuse portions of the tubes within the passages of the body of manifold fitting to the upper portion of the body of manifold fitting. Utilizing plastics which are identical or relatively similar enables the plastic components to simultaneously reach their melting points or reach them at very similar temperatures. Proper selection of such plastics ensures that one component does not receive excessive heat once it reaches its melting point as the other component is still approaching its melting point. Avoidance of excessive heating assists in preserving the geometrical shape of the inner diameter of the tubes. Deformation of the tubes from their original geometry during heating could prevent a fluid from freely flowing through the tubes.

The longer that the components are exposed to the heat then the deeper the penetration of the heat. The weld depth may be twice the thickness of the wall of the tubes to ensure that there is a secure seal. As mentioned above, the walls of tubes 140 are selected to be sufficiently thin to permit rapid and efficient heat transfer. The wall thickness is also selected to be sufficiently thick to withstand the pressure of the pressurized liquid and to prevent weeping of the fluid. For example, when the fluid is hydrofluoric acid (HF) pressurized to about 45 psi, the tube may have a wall thickness ranging from about 0.01 inches to about 0.02 inches. More particularly, a tube formed for such use from polyperfluoroalkoxyethylene may have a wall thickness of about 0.02 inches. To fuse such tubes to the body of a manifold fitting, an infrared heater is set at a temperature of 600° F. and positioned about 0.5 inch away from the face of the body of the manifold fitting and the inlet ends of the tubes for about 1 minute.

The embodiment of heat exchanger apparatus 100' shown in FIGS. 7-8 and FIGS. 9A-9B which has only a single gas separator is essentially identical to the heat exchanger apparatus shown in FIGS. 14C. As mentioned above, embodiments with only one gas separator may be used in environments in which it is desirable to keep a liquid bath above or below the environment temperature.

Like the embodiment of the heat exchanger apparatus having two gas separators, a heat exchanger apparatus having a single gas separators controls the delivery of the gas stream contacting the plurality of heat transfer components by: selectively enabling the gas to flow into the gas separator, selectively adjusting the pressure of the gas flowing into the gas separator, selectively adjusting the gas separator to alter the ratio of the cold and hot gas streams.

Figure 8:
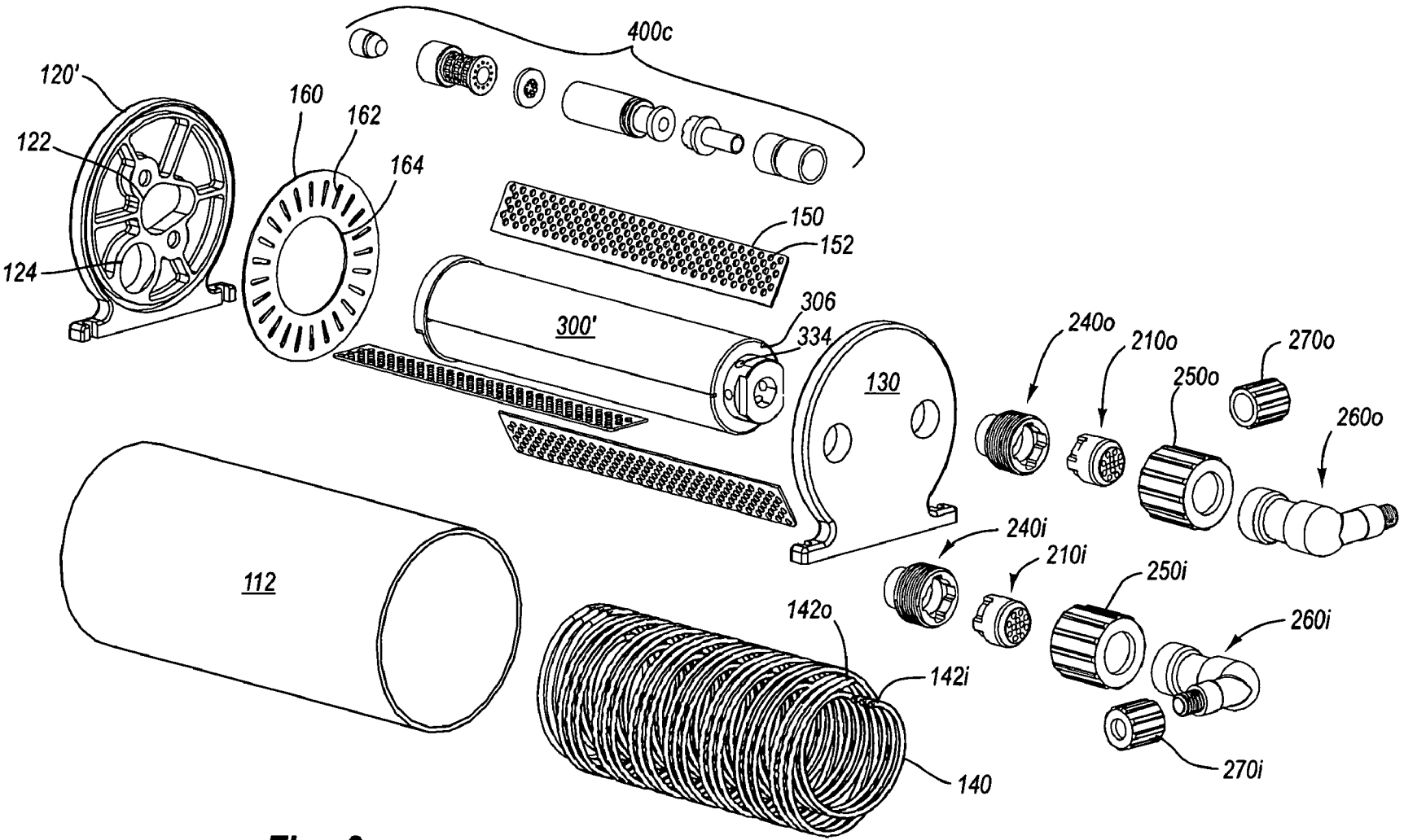
FIG. 8 is an exploded perspective view of the components of a heat exchanger apparatus having one gas separator adapted to separate pressurized gas into gas streams having different temperatures.
Figure 9A:
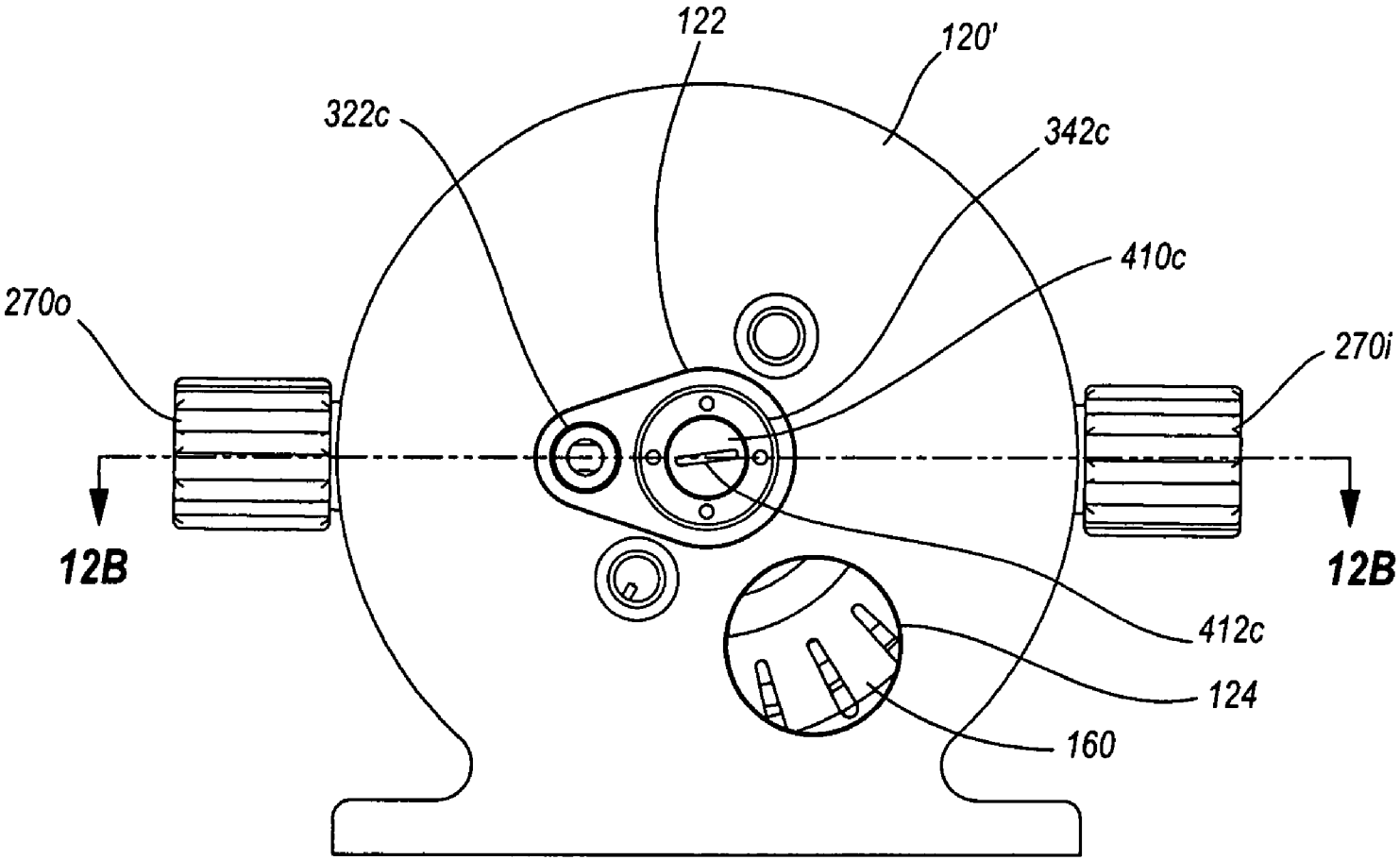
FIG. 9A is a perspective view of the side of the heat exchanger apparatus shown in FIG. 7.
Figure 9B:
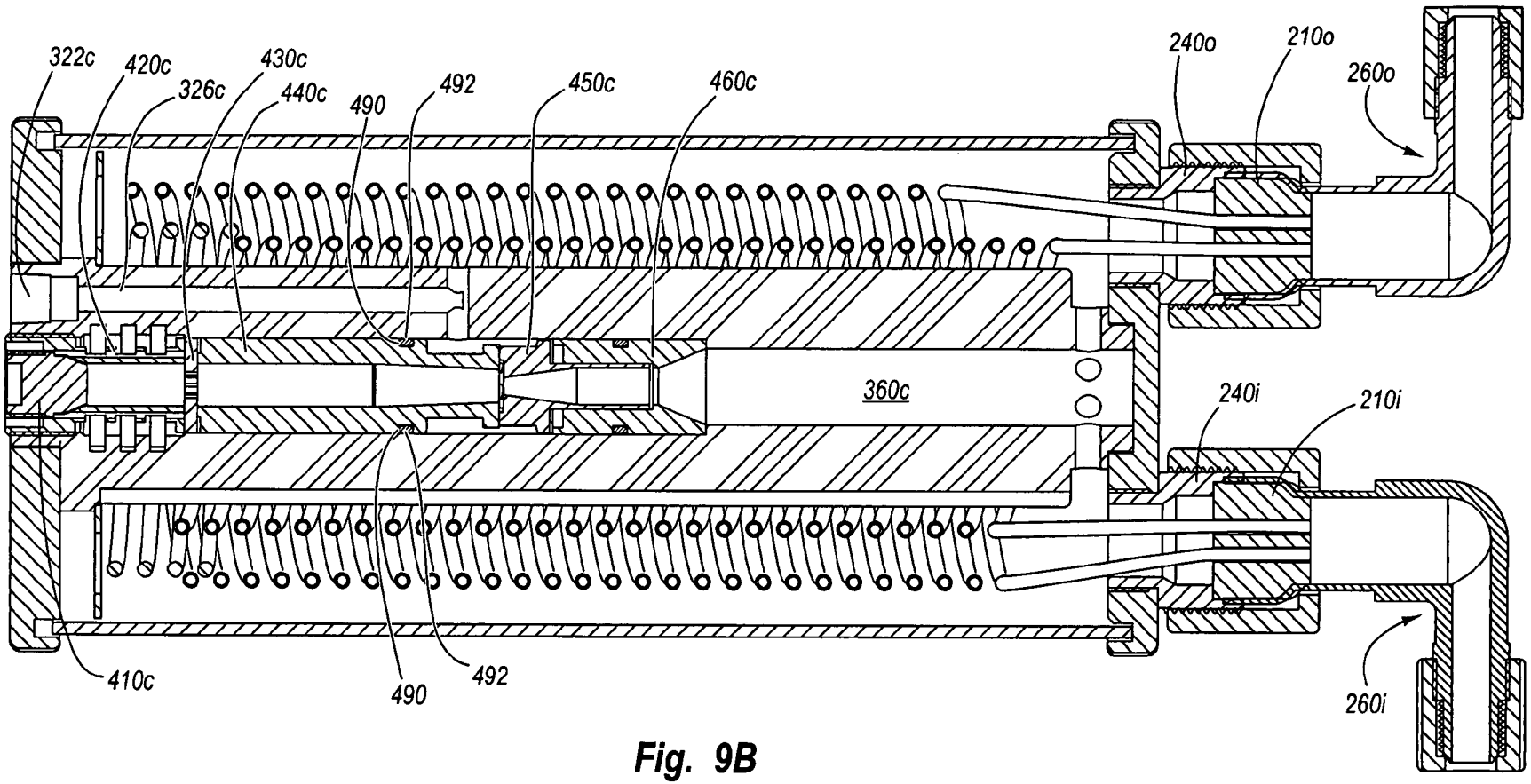
FIG. 9B is a cross-sectional view of the heat exchanger apparatus taken along cutting line 9B-9B in FIG. 9A.

As best seen in FIG. 9A, end cap 120' has a different configuration compared with end cap 120 since there is only one gas separator in this embodiment of the heat exchanger apparatus. Flow restrictor 410*c* for gas separator 400*c* is accessed by access portal 122. The other components shown in FIG. 8 are identical to those shown in FIG. 3A. As discussed below with reference to FIG. 9B, the internal configuration of gas separator housing 300' differs from gas separator housing 300.

Figure 4C:
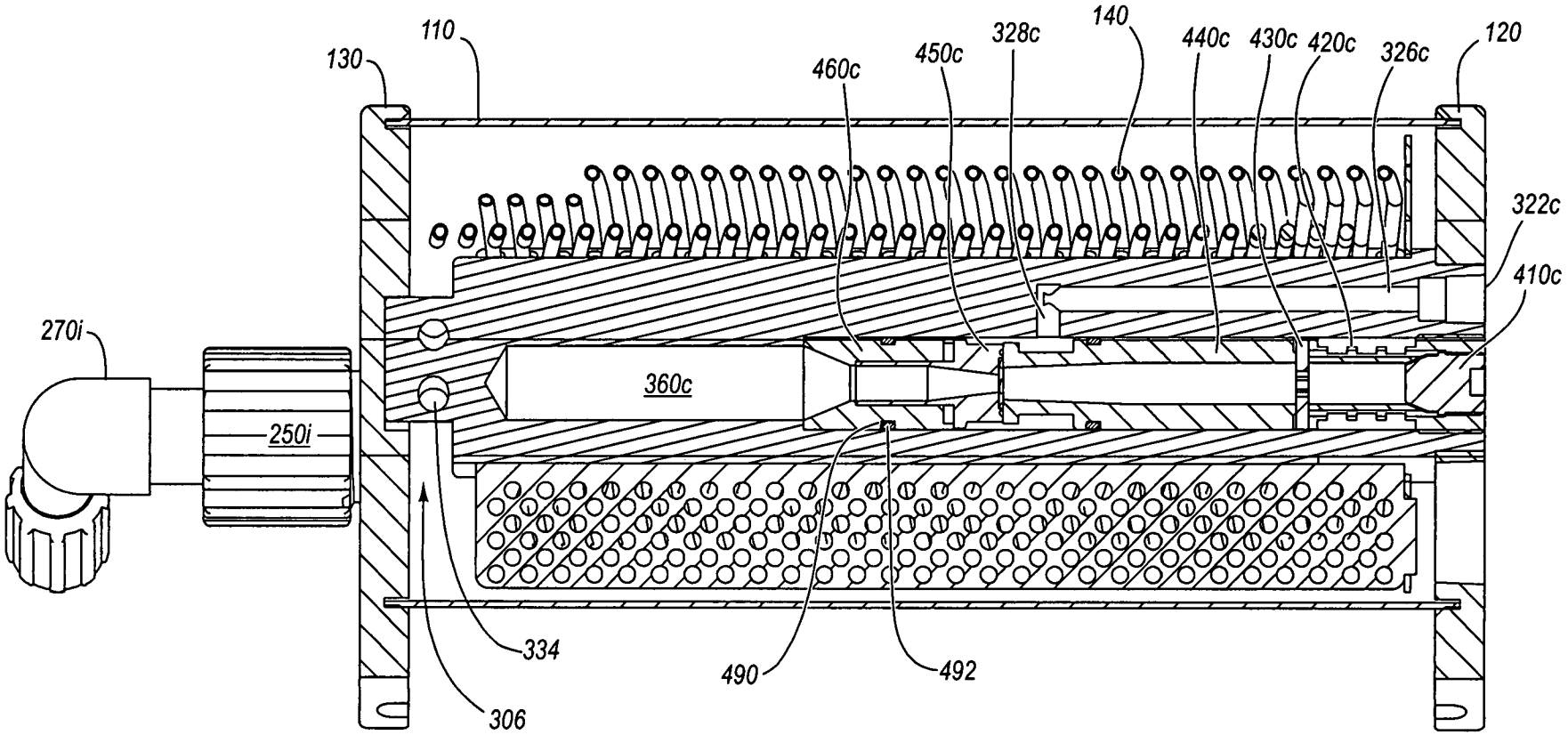
FIG. 4C is a cross-sectional view of the heat exchanger apparatus taken along cutting line 4G-4C in FIG. 4A.

FIG. 9B shows the same view of apparatus 100' as is shown of apparatus 100 in FIG. 4C. Since gas separator 300*c* is the only gas separator in gas separator housing 300', it is centered differently from separator 300*c* within gas separator housing 300. Another difference is that there is not a delivery chamber as the cold gas stream chamber 360*c* directly delivers the cold gas stream out of delivery portals 334.

As mentioned above, the heat transfer tubes disclosed herein are examples of heat transfer components. The heat transfer tubes are also examples of heat transfer means for receiving a pressurized fluid in the housing for heat transfer as delivered from a fluid source, providing sufficient surface area for effective heat and transfer and for delivering the fluid out of the housing to be routed back to the fluid source.

The support combs are examples of means for spatially orienting the heat transfer means for effective heat transfer. The baffle is an example of means for directing the heat transfer gas stream across the heat transfer means, for minimizing contact with the heat transfer means form the bypass gas stream as the bypass gas stream is directed out of an exhaust vent, and for directing the heat transfer gas stream out of the exhaust vent after the heat transfer gas stream has contacted the heat transfer means.

The gas separators are examples of temperature changing means for receiving pressurized gas, for separating the pressurized gas into a high temperature stream and a low temperature stream relative to the temperature of the pressurized gas received, for directing one of the gas streams into contact with the plurality of heat transfer components and then out of the housing, and for directing the other stream out of the housing while limiting the contact with the heat transfer means. Such temperature changing means are also examples of means for cooling or heating the fluid in the heat transfer means. Other examples of means for heating or cooling the fluid in the heat transfer means include a hot bath or cold bath through which the heat transfer means passes.

The inlet manifold fittings are examples of inlet manifold means for providing fluid communication between the plurality of heat transfer means and an inlet fluid communicator having a conduit in fluid communication with the fluid source to enable the plurality of heat transfer means to receive the pressurized fluid in the housing from the fluid source. The outlet manifold fittings are examples of outlet manifold means for providing fluid communication between the plurality of heat transfer means and an outlet fluid communicator having a conduit in fluid communication with the fluid source to enable the plurality of heat transfer means to deliver the pressurized fluid out of the housing to the fluid source.

It will be obvious to those having skill in the art that many changes may be made to the details of the above-described embodiments without departing from the underlying principles of the invention. The scope of the present invention should, therefore, be determined only by the following claims. Note also that elements recited in means-plus-function format are intended to be construed in accordance with 35 U.S.C. § 112 ¶6.

The invention claimed is:

1. A method for heat transfer and temperature control of a process liquid comprising:

circulating a liquid from a source of liquid into a plurality of heat transfer components contained within a first housing and then out of the heat transfer components to the source such that at least a portion of the liquid that is returned to the source from the plurality of heat transfer components is delivered again to the plurality of heat transfer components;

sensing the temperature of the circulating liquid;

automatically controlling delivery of pressurized gas to a first gas separator that is located within the first housing based on a sensed temperature of the liquid;

separating the pressurized gas by vortex expansion into a first gas stream at a first temperature and a second gas stream at a second temperature that is different from the first temperature, wherein separating the pressurized gas is performed within the first gas separator, and wherein the first gas separator is encircled by the plurality of heat transfer components; and delivering the first gas stream into contact with the plurality of heat transfer components and then out of the first housing while limiting contact of the second gas stream with the plurality of heat transfer components.

2. The method of claim 1, further comprising transferring liquid from a first conduit into a plurality of openings at a first end of the plurality of heat transfer components and transferring liquid from a plurality of openings at a second end of the plurality of heat transfer components into a second conduit.

3. The method of claim 1, further comprising transferring heat through walls defined by the plurality of heat transfer components such that heat is either conveyed from liquid flowing through the plurality of heat transfer components to the first gas stream or conveyed from the first gas stream to liquid flowing through the plurality of heat transfer components.

4. The method of claim 1, further comprising heat bonding the plurality of heat transfer components to a fitting prior to circulating the liquid.

5. The method of claim 4, further comprising preventing fluid communication between the circulating liquid and the first gas stream inside the first housing via the filling.

6. The method of claim 1, further comprising pressurizing the liquid such that the liquid flowing within the heat transfer components is pressurized.

7. The method of claim 1, further comprising controlling the delivery of the first gas stream by selectively enabling the pressurized gas to flow into the first gas separator.

8. The method of claim 1, further comprising selectively adjusting the pressure of pressurized gas flowing into the first gas separator to control the delivery of the first gas stream flow to the plurality of heat transfer components.

9. The method of claim 1, further comprising selectively adjusting the first gas separator positioned in the first housing to alter the ratio of the first gas stream to the second gas stream flows.

10. The method of claim 1, further comprising:

controlling delivery of pressurized gas to a second gas separator based on a sensed temperature of the liquid;

separating the pressurized gas by vortex expansion into a third gas stream and a fourth gas stream, the third and fourth gas streams being at different temperatures; and delivering the third gas stream into contact with the plurality of heat transfer components and then out of the first housing.

11. The method of claim 10, further comprising selectively separating pressurized gas by vortex expansion into either the first and second gas streams or the third and fourth gas streams, wherein the first gas stream is at a temperature that is below the temperature of the liquid and the third gas stream is at a temperature that is above the temperature of the liquid.

12. The method of claim 1, wherein the step of separating the pressurized gas by vortex expansion into a first gas stream and a second gas stream is performed within a second housing.

13. The method of claim 12, wherein the second housing is within the first housing.

14. The method of claim 1, wherein the step of controlling the delivery of pressurized gas to the first housing is performed by a controller that is electrically coupled to a temperature sensor positioned to determine the temperature of the liquid.

15. The method of claim 1, further comprising maintaining the temperature of the liquid within a predetermined temperature range.

16. The method of claim 1, wherein the second gas stream is directed out of the first housing via a flow path that is isolated from an input end and from an output end of the plurality of heat transfer components.

17. The method of claim 1, further comprising directing the first gas stream and the second gas stream to opposite sides of a baffle.

18. method of claim 1, further comprising recombining the first gas stream with the second gas stream within the first housing.

19. The method of claim 1, further comprising venting the first gas stream and the second gas stream from the first housing through a common opening.

* * * * *